US010702450B2

(12) United States Patent
Zgoda et al.

(10) Patent No.: US 10,702,450 B2
(45) Date of Patent: Jul. 7, 2020

(54) CHEST COMPRESSION DEVICES, SYSTEMS, AND METHODS

(71) Applicant: Respiratory Technologies, Inc., St. Paul, MN (US)

(72) Inventors: Karl Zgoda, Lakeville, MN (US); Ryan Staab, Minneapolis, MN (US); Shad Lindrud, Albertville, MN (US); Hamid Ziaimehr, Arden Hills, MN (US); Leland Hansen, St. Paul, MN (US); Gary Hansen, Inver Grove Heights, MN (US); John Rock, Minneapolis, MN (US); Robert Buehler, Wayzata, MN (US); K. James Ehlen, Golden Valley, MN (US)

(73) Assignee: Respiratory Technologies, Inc., St. Paul, MN (US)

( * ) Notice: Subject to any disclaimer, the term of this patent is extended or adjusted under 35 U.S.C. 154(b) by 496 days.

(21) Appl. No.: 15/478,690

(22) Filed: Apr. 4, 2017

(65) Prior Publication Data

US 2017/0281460 A1 Oct. 5, 2017

Related U.S. Application Data

(60) Provisional application No. 62/317,977, filed on Apr. 4, 2016.

(51) Int. Cl.

| | |
|---|---|
| ***A61H 31/00*** | (2006.01) |
| ***A61H 23/04*** | (2006.01) |
| ***A61H 9/00*** | (2006.01) |

(52) U.S. Cl.

CPC ..... *A61H 31/004* (2013.01); *A61H 9/0078* (2013.01); *A61H 23/04* (2013.01);
(Continued)

(58) Field of Classification Search

CPC .... A61H 31/004; A61H 9/0078; A61H 23/04; A61H 2205/084; A61H 2230/425;
(Continued)

(56) References Cited

U.S. PATENT DOCUMENTS 2,741,265 A 4/1956 Poor
4,086,920 A * 5/1978 Miniere ..... A61H 9/0078 601/150

(Continued)

FOREIGN PATENT DOCUMENTS

WO WO2007033304 A2 3/2007

OTHER PUBLICATIONS

Caleffi, Water hammer arrester, Feb. 9, 2015. https://www.caleffi.com/international/en-int/news/water-hammer-arrester (Year: 2015).*

*Primary Examiner* — Bradley H Philips
*Assistant Examiner* — Vincent D Hoang
(74) *Attorney, Agent, or Firm* — Daniel H. Brean

(57) ABSTRACT

A percussive pulsing therapy device configured for delivering pulsating or intermittent airflow to a patient device, such as a patient vest. The percussive pulsed air device may have an airflow generator for controlling amplitude of the percussive pulsed air and a pulse frequency control module for controlling frequency of the percussive pulsed air. In some embodiments, the pulse frequency control module may have a rotatable fan blade, such as a circular fan blade having one or more cutout portions. In some embodiments, the rotating fan blade may have one or more channels configured to redirect percussive pulsed air. Moreover, a percussive pulsed air device of the present disclosure may have a dampening element flowably coupled to an inlet of the pulse frequency control module. In some embodiments, at least one inlets of the pulse frequency control module may be arranged on a different airflow plane than one or more outlets.

13 Claims, 29 Drawing Sheets

(52) U.S. Cl.
CPC ..... *A61H 2201/0169* (2013.01); *A61H 2201/0207* (2013.01); *A61H 2201/0214* (2013.01); *A61H 2201/0228* (2013.01); *A61H 2201/0285* (2013.01); *A61H 2201/1238* (2013.01); *A61H 2201/1619* (2013.01); *A61H 2201/5005* (2013.01); *A61H 2201/5012* (2013.01); *A61H 2201/5056* (2013.01); *A61H 2201/5071* (2013.01); *A61H 2201/5097* (2013.01); *A61H 2205/084* (2013.01); *A61H 2230/425* (2013.01)

(58) Field of Classification Search
CPC .... A61H 2201/1238; A61H 2201/5005; A61H 2201/5056; A61H 2201/5012; A61H 2201/1619; A61H 2201/0285; A61H 2201/0228; A61H 2201/0214; A61H 2201/0207
USPC ..... 601/152; 251/211, 304; 137/115.15, 137/115.2, 116.5, 625.29
See application file for complete search history.

(56) References Cited

U.S. PATENT DOCUMENTS

| | | | | |
|---|---|---|---|---|
| 5,370,603 | A * | 12/1994 | Newman | A61H 9/0078 601/150 |
| 6,701,957 | B2 * | 3/2004 | McCarty | F16K 47/04 137/625.3 |
| 6,958,046 | B2 | 10/2005 | Warwick et al. | |
| 7,597,670 | B2 | 10/2009 | Warwick et al. | |
| 7,762,967 | B2 | 7/2010 | Warwick et al. | |
| 2007/0093731 | A1 * | 4/2007 | Warwick | A61H 31/00 601/41 |
| 2007/0225612 | A1 | 9/2007 | Mace et al. | |
| 2009/0306556 | A1 | 12/2009 | Hansen | |
| 2010/0249634 | A1 | 9/2010 | Hansen | |
| 2013/0289455 | A1 | 10/2013 | Clapp | |
| 2016/0151232 | A1 | 6/2016 | Clapp | |
| 2017/0007494 | A1 | 1/2017 | Rock | |

* cited by examiner

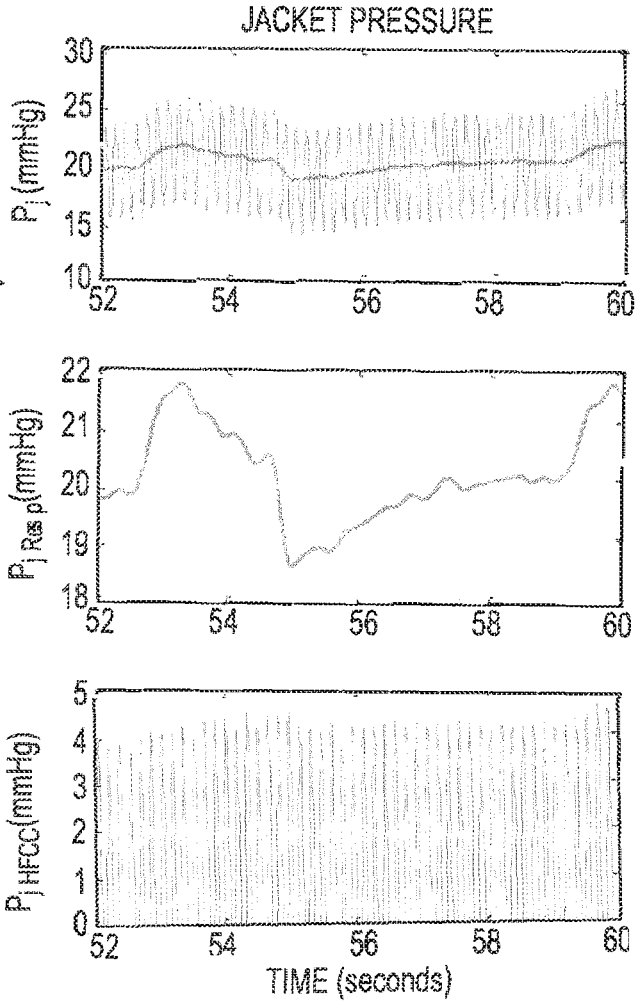
FIG. 20A
FIG. 20B
FIG. 20C
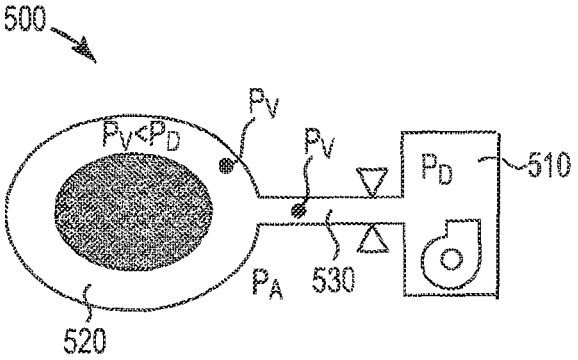
FIG. 21

CHEST COMPRESSION DEVICES, SYSTEMS, AND METHODS

CROSS-REFERENCE TO RELATED APPLICATIONS

This application claims the benefit of U.S. Provisional Patent Application No. 62/317,977, titled Chest Compression Devices, Systems, and Methods, filed Apr. 4, 2016, the contents of which are hereby incorporated by reference herein in their entirety.

FIELD OF THE INVENTION

The present application is generally directed to high frequency chest compression (HFCC) and high frequency chest wall oscillation (HFCWO) therapy devices, systems, and methods.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A variety of chronic lung conditions, including cystic fibrosis, bronchiectasis, chronic obstructive pulmonary disease (COPD), chronic bronchitis, primary ciliary dyskinesia, a variety of pulmonary conditions, including those resulting from neuromuscular disorders, and many other conditions can cause or have the potential to lead to excess secretions in the lungs. Treatment for clearing or preventing excess secretions can employ various therapies, including nebulizer therapies, mechanical airway clearance therapies, and/or other therapies.

Mechanical airway clearance therapies conventionally included manual percussion techniques to aid in the clearance of mucus. However, a variety of chest wall oscillation and chest compression devices have been developed to deliver high frequency chest compression (HFCC)/high frequency chest wall oscillation (HFCWO) therapy to a patient. HFCC/HFCWO therapies can aid in the clearance of excess mucus in airways by both mechanically moving the mucus and/or affecting the viscosity of the mucus. Such devices typically include the use of an air delivery device in combination with a patient-worn vest. The inflatable vest is linked to an air pulse generator that provides air pulses to the vest during inspiration and/or expiration. The air pulses produce transient air flow spikes in the airways, which moves mucus toward the larger airways where it can be cleared by coughing.

HFCC/HFCWO devices are most effective when used properly and as directed, but in many cases, patients may have difficulties adhering to a particular treatment regimen. In some cases, HFCC/HFCWO devices can be uncomfortable, poorly fitted, or bulky, and operation of the devices may include excessive noise. In some cases, patients may, perhaps unknowingly, use a therapy device ineffectively or incorrectly. In some cases, adherence may be low where patients are required to use both nebulizer and mechanical airway clearance therapies.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a percussive pulsed air device. The device may have an airflow generator controlling an amplitude of the percussive pulsed air, and a pulse frequency control module controlling a frequency of the percussive pulsed air. In some embodiments, the pulse frequency control module may have a rotatable fan blade, which may have at least one cutout portion. The percussive pulsed air device may additionally have one or more ports for flowably coupling to a patient device. In some embodiments, the patient device may be a patient vest. The percussive pulsed air device may have a user interface in some embodiments. In some embodiments, the fan blade of the pulse frequency control module may have a circular shape. The at least one cutout portion of the fan blade may be arranged on a first half of the fan blade and a second half of the fan blade may be provided without a cutout portion. In some embodiments, the fan blade may have two cutout portions. The cutout portion may have a substantially arced or semi-circular shape. In some embodiments, the fan blade may additionally have one or more channels to redirect airflow from the airflow generator. In some embodiments, the at least one cutout portion may be arranged on a first half of the fan blade, and the at least one channel may be arranged on a second half of the fan blade. Moreover, the at least one channel may redirect airflow from the airflow generator to an exhaust in some embodiments. The channel may have a substantially arced or semi-circular shape. In some embodiments, the percussive pulsed air device may have a pressure control unit for receiving the percussive pulsed air from the pulse frequency control module and providing the percussive pulsed air to the patient device via the one or more ports.

The present disclosure, in one or more embodiments, additionally relates to another percussive pulsed air device. The percussive pulsed air device may have an airflow generator controlling an amplitude of the percussive pulsed air and a pulse frequency control module controlling a frequency of the percussive pulsed air. The device may additionally have at least one air inlet for directing airflow into the pulse frequency control module and at least one outlet for directing airflow from the pulse frequency control module. In some embodiments, the at least one inlet may be arranged on a different airflow plane than the at least one outlet. In some embodiments, the percussive pulsed air device may additionally have a pressure control unit for receiving the percussive pulsed air from the pulse frequency control module and providing the percussive pulsed air to a patient device. In some embodiments, the at least one outlet may be arranged on the pulse frequency control module. The percussive pulsed air device may have two inlets and two outlets in some embodiments, and the two inlets may be arranged on a different airflow plane than the two outlets.

The present disclosure, in one or more embodiments, additionally relates to another percussive pulsed air device. The air device may have an airflow generator controlling an amplitude of the percussive pulsed air and a pulse frequency control module controlling a frequency of the percussive pulsed air. In some embodiments, the pulse frequency control module may have a closeable valve. The device may additionally have an inlet for directing airflow into the pulse frequency control module and a dampening element flowably coupled to the inlet. The dampening element may have a chamber configured to receive percussive pulsed air from the inlet, and the percussive pulsed air may be directed to the chamber when the valve of the pulse frequency control module is closed. In some embodiments, the dampening element may additionally have a disk arranged in the chamber. The dampening element may have a spring arranged in the chamber and configured to compress in response to percussive pulsed air in the chamber. In some embodiments, the percussive pulsed air in the chamber may be released when the valve of the pulse frequency control module is opened. Moreover, in some embodiments, a volume of the chamber may be modifiable.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

FIG. 20A shows a local average between peak and minimum pulse pressure values of a percussive pulsed air system of the present disclosure, according to one or more embodiments.

FIG. 20B shows a respiratory wave form for a person, according to one or more embodiments.

FIG. 20C shows a differential pulse wave form resulting from subtracting a respiratory wave form from peak and minimum pulse pressure values, according to one or more embodiments.

FIG. 21 is a diagram of a percussive pulsed air system of the present disclosure, according to one or more embodiments.

DETAILED DESCRIPTION

The present disclosure relates to a percussive pulsing therapy device configured for delivering pulsating or intermittent airflow to a patient device, such as a patient vest worn by a patient. The airflow delivered to the patient vest may have an amplitude and a frequency, each of which may be adjustable in some embodiments. For example, a user, such as a patient, or caregiver may adjust the amplitude and/or frequency prior to and/or during a therapy session. To receive a treatment, a user may wear the patient vest around his or her chest and turn on the percussive pulsing device such that percussive, pulsed air may be delivered to the user's chest region. The percussive pulsed air device may have an airflow generator for controlling amplitude of the percussive pulsed air and a pulse frequency control module for controlling frequency of the percussive pulsed air. In some embodiments, the pulse frequency control module may have a rotatable fan blade, such as a circular fan blade having one or more cutout portions. The present disclosure additionally relates to means for mitigating deadhead within a percussive pulsed air device, such as providing one or more channels on the rotating fan blade or providing a dampening element flowably coupled to an inlet of the frequency control module. The present disclosure additionally relates to means for mitigating noise, high temperature, and/or contaminants within a percussive pulsed air device. Additionally, the present disclosure relates to means for measuring pressure at one or more locations so as to increase efficacy of a percussive pulsed air therapy session for a patient. The present disclosure additionally relates to methods of monitoring patient adherence to percussive pulsed air device therapy by monitoring pressure differentials. The present disclosure additionally relates to a percussive pulsed air device having a nebulizer for providing medicinal therapy in combination with percussive pulsed air therapy. Moreover, a percussive pulsed air device of the present disclosure may have an intrapulmonary percussive ventilation device for providing intrapulmonary percussive ventilation therapy in combination with percussive pulsed air therapy. In some embodiments, a percussive pulsed air device of the present disclosure may have a patient mouthpiece or other handheld patient device configured to measure pressure at a patient's mouth or other location. A percussive pulsed air device of the present disclosure may additionally have means for venting or releasing pressure during patient inhalation.

Figure 1:
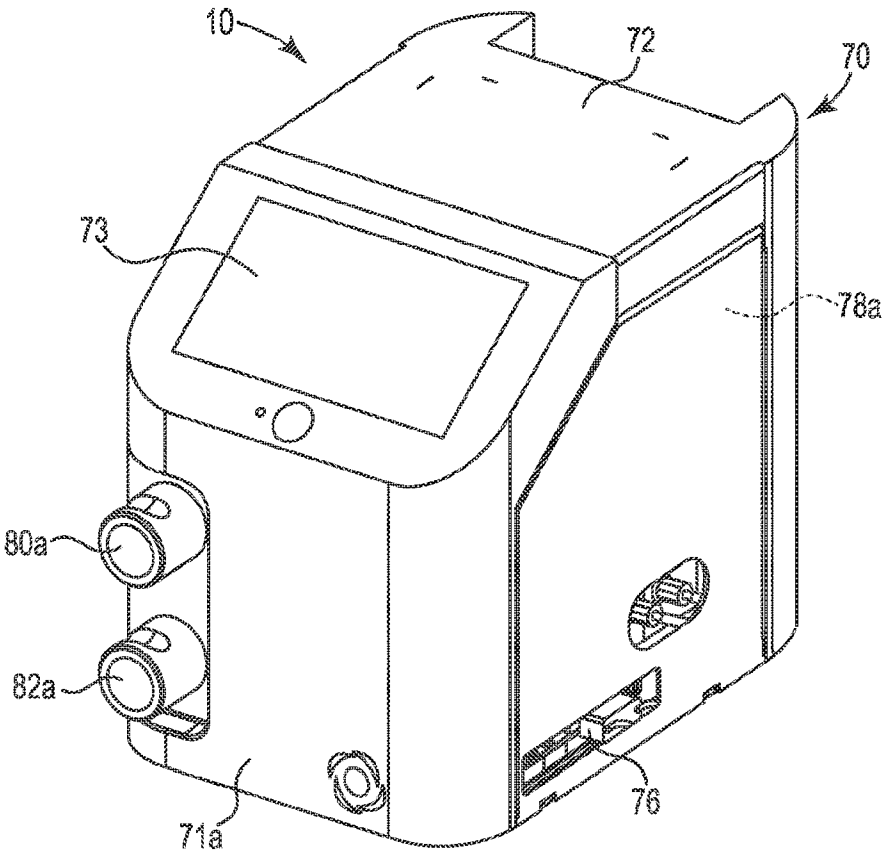
FIG. 1 is a perspective view of a percussive pulsed air device of the present disclosure, according to one or more embodiments.
Figure 2:
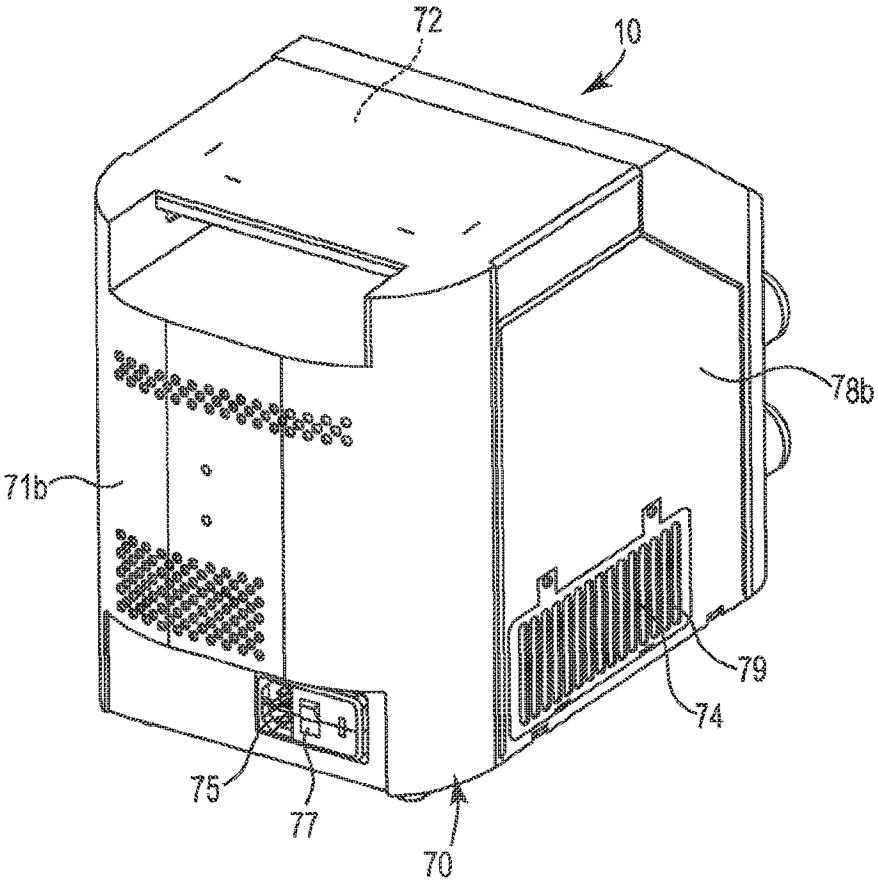
FIG. 2 is another perspective view of the percussive pulsed air device of FIG. 1, according to one or more embodiments.

Turning now to FIGS. 1 and 2, a percussive pulsing therapy device 10 according to one or more embodiments of the present disclosure is shown. The device 10 may be configured to couple to, and deliver percussive, pulsed air to, a patient device, such as a patient vest or jacket, via one or more lines or hoses. While referred to herein as a vest or patient vest, it may be appreciated that the patient device may be any suitable device configured to receive percussive, pulsed air from the device 10 and deliver such air to a patient. For example, a patient device of the present disclosure may be, or may be similar to, those described in U.S. patent application Ser. No. 13/850,286, entitled Air Vest, and filed Mar. 25, 2013, the contents of which are hereby incorporated herein by reference in their entirety.

As described above, the device 10 may further be configured to provide percussive, pulsed air to the patient vest or other patient device. The device 10 may additionally be configured to provide operational controls and/or information related to a patient's therapy. In some embodiments, the device 10 may generally have a shell or housing 70, one or more ports 80*a*, 82*a* for delivering air to a patient vest or other patient device, an air intake 74, one or more electrical connections 75, one or more telecom connections 76, and a power switch 77. The device 10 may additionally have a user interface 73 in some embodiments. In some embodiments, the device 10 may have additional or alternative components.

The housing 70 may be configured to house the electrical and/or mechanical components of the device 10. The housing 70 may have any suitable shape and size configured to house the electrical and/or mechanical components of the device. In some embodiments, the housing 70 may have a generally cubic shape, having a front portion 71*a*, a back portion 71*b*, a top portion 72, a first side portion 78*a*, and a second side portion 78*b*. In other embodiments, the housing 70 may have any other suitable shape with any suitable number of sides, faces, or portions. The housing 70 may be composed of plastic, metal, or other suitable materials.

The one or more ports 80*a*, 82*a* may be configured to couple to a patient vest. The ports 80*a*, 82*a* may generally be configured to allow air to travel between the percussive pulsing therapy device 10 and the vest. The ports 80*a*, 82*a* may be arranged at any suitable location on the device 10. For example, as shown in FIG. 1, the ports 80*a*, 82*a* may extend through a front portion 71*a* of the housing 70. In other embodiments, the ports 80*a*, 82*a* may be arranged differently on the device 10. In some embodiments, the ports 80*a*, 82*a* may be or include quick connect air couplings for coupling to hoses or lines. Each quick connect air coupling may include male and female portions and a latch or other release for readily disconnecting the portions. The quick connect air couplings may minimize inadvertent air hose disconnects and improve freedom of movement as the locking air couplings may permit rotation between the air hose and the vest or between the air hoses and the device 10. In other embodiments, the ports 80*a*, 82*a* may include any other suitable coupling mechanisms for coupling to air hoses or lines.

The air intake 74 may be configured to allow air, such as atmospheric air, to be pulled into the device 10. The air intake 74 may be an opening into the device 10, such as a grated or slotted opening. The air intake 74 may generally be arranged in any suitable location on the device 10. For example, as shown in FIG. 2, the air intake 74 may be positioned on or through a second side portion 78*b* of the housing 70. In some embodiments, the device 10 may have a filter 79 arranged over or across the air intake 74. The filter 79 may be configured to minimize debris entry into the device 10. In some embodiments, the filter 79 may be removable, such that it may be periodically removed, and cleaned and/or replaced. In some embodiments, the filter 79, and/or any other filter of the device 10, may be removable and/or replaceable without the need for screwdrivers or other tools. In some embodiments, air exiting a patient vest may be routed to the air intake 74.

In some embodiments, the device 10 may have one or more electrical connections 75 and/or one or more telecom connections 76. The connections 75, 76 may provide for coupling one or more devices or components to the device 10 via wired or wireless connections. For example, a computer, tablet, smartphone, or other device may connect to the percussive pulsing therapy device 10 using a wired or wireless connection. The electrical connection(s) 75 and/or telecom connection(s) 76 may be arranged at any suitable location on the device 10.

The device 10 may be powered by AC or DC power. For example, in some embodiments, the device 10 may be battery-powered. In some embodiments, the device 10 may have a power switch 77 for operating the device. The power switch 77 may be arranged at any suitable location on the device 10. In other embodiments, the device 10 may be powered by, for example, being coupled to a power source such as a wall outlet. That is, the act of plugging the device into the wall outlet may turn the device on without the need for a power switch.

In some embodiments, the device 10 may have one or more processors, databases, controllers, software, hardware, and/or other components configured to collect and/or store data, analyze data, process data, and/or display data related to the device, a patient, or percussive pulsed air therapy. For example, these components may store therapy settings for a patient's percussive pulsed air therapy, medical history for the patient, statistics gathered during a patient's one or more therapy sessions, and/or other data. In some embodiments, these components may analyze a patient's data to provide recommendations, encouragement, and adherence monitoring, for example. Some of these functions are described, for example, in U.S. patent application Ser. No. 15/255,670, entitled HFCC Therapy System Providing Patient Interventions for Improved Adherence, and filed Sep. 2, 2016, and/or U.S. patent application Ser. No. 14/861,362, entitled HFCC Therapy System Providing Device Adherence Data, and filed Sep. 22, 2015, the contents of each of which are hereby incorporated by reference herein in their entirety.

The user interface 73 may be configured for allowing a user, such as a patient or patient's caregiver, to interact with the device 10. For example, the user interface 73 may allow a user to select one or more settings, such as amplitude and frequency, for the percussive pulsed air therapy. Additionally or alternatively, the user interface 73 may be configured to display information, such as information related to a patient's current or previous treatment(s) or other patient information or device information. The user interface 73 may include any suitable combination of user interface components or elements. For example, in some embodiments, the user interface 73 may include a visual display. In some embodiments, the user interface 73 may include one or more buttons, dials, or other mechanical options. Additionally or alternatively, the user interface 73 may include a touch screen or other electronic options. The user interface 73 may generally allow a user to make various adjustments or selections, or to provide inputs or other information. The user interface 73 may provide a user with access to stored or collected data in some embodiments. The user interface 73 may have additional or alternative options in other embodiments.

While the device 10 may be operated locally by a user or caregiver, it may additionally or alternatively by operated or accessed remotely in some embodiments. That is, a caregiver, doctor, provider, manufacturer, or other user may access the device's stored data over a wired or wireless network in order to obtain information.

Figure 3A:
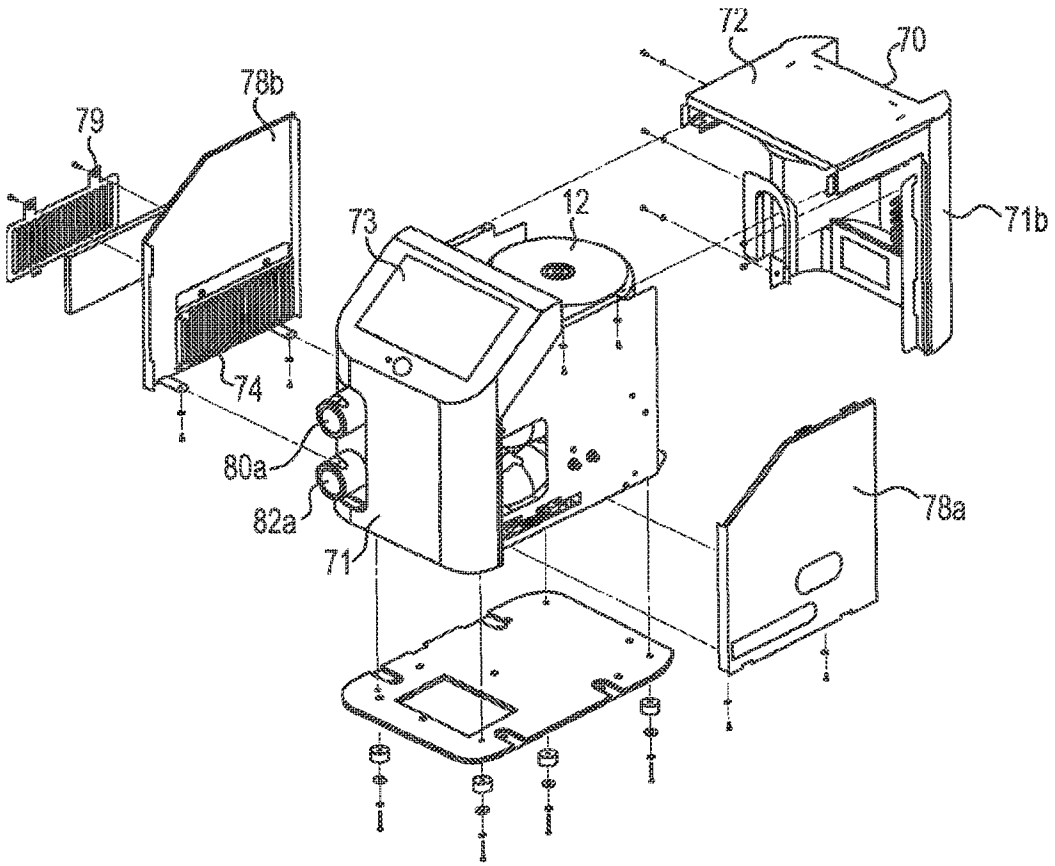
FIG. 3A is an exploded view of the percussive pulsed air device of FIG. 1, according to one or more embodiments.
Figure 3B:
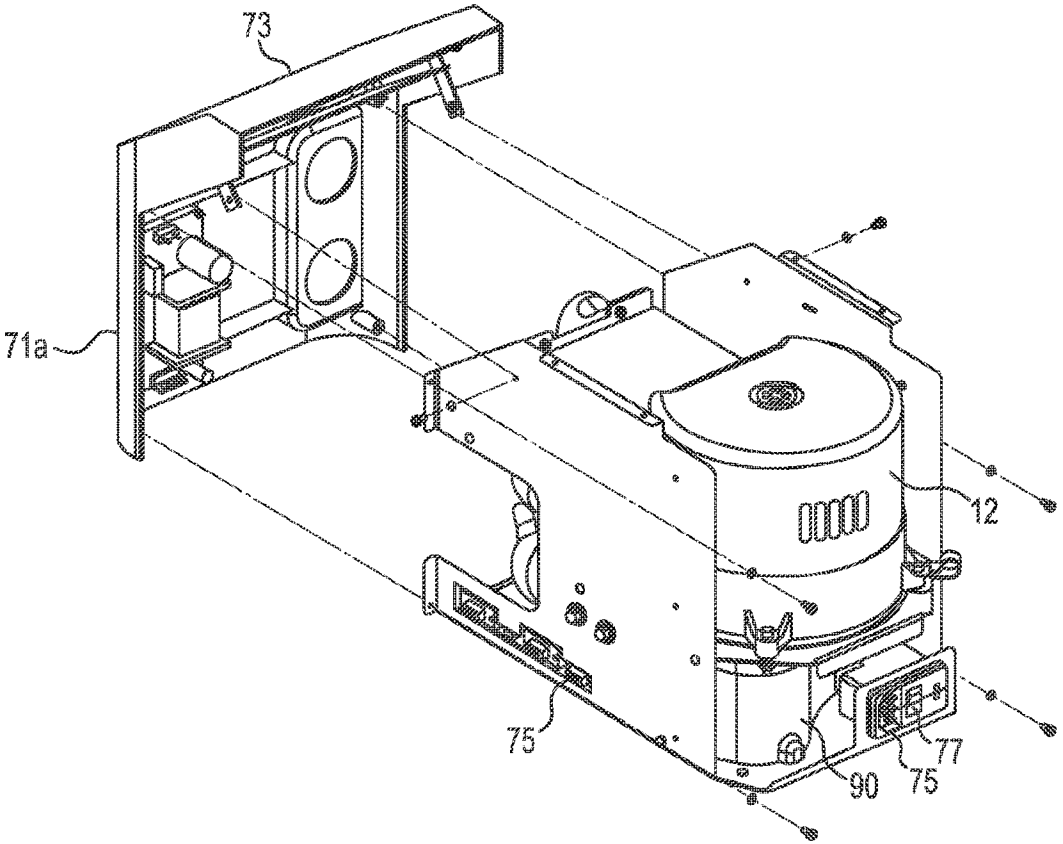
FIG. 3B is an alternate exploded view of the percussive pulsed air device of FIG. 1, according to one or more embodiments.
Figure 3C:
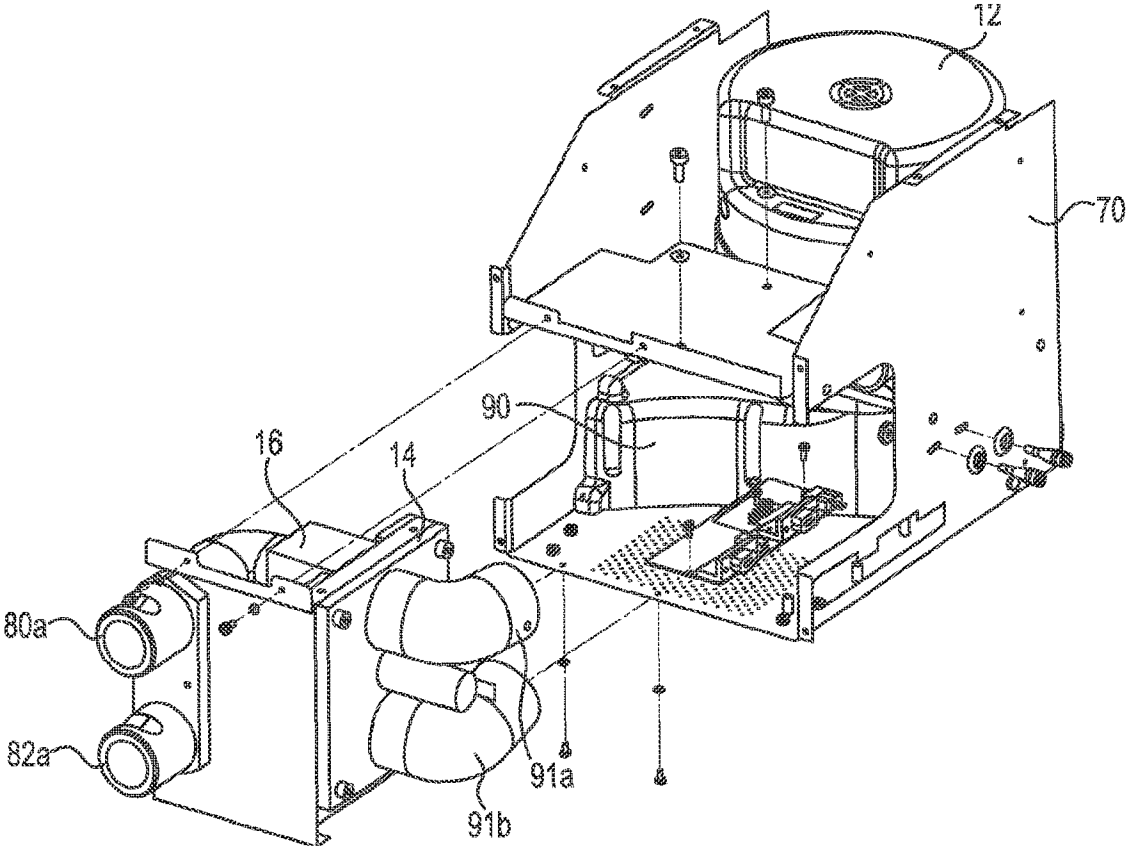
FIG. 3C is an alternate exploded view of the percussive pulsed air device of FIG. 1, according to one or more embodiments.
Figure 3D:
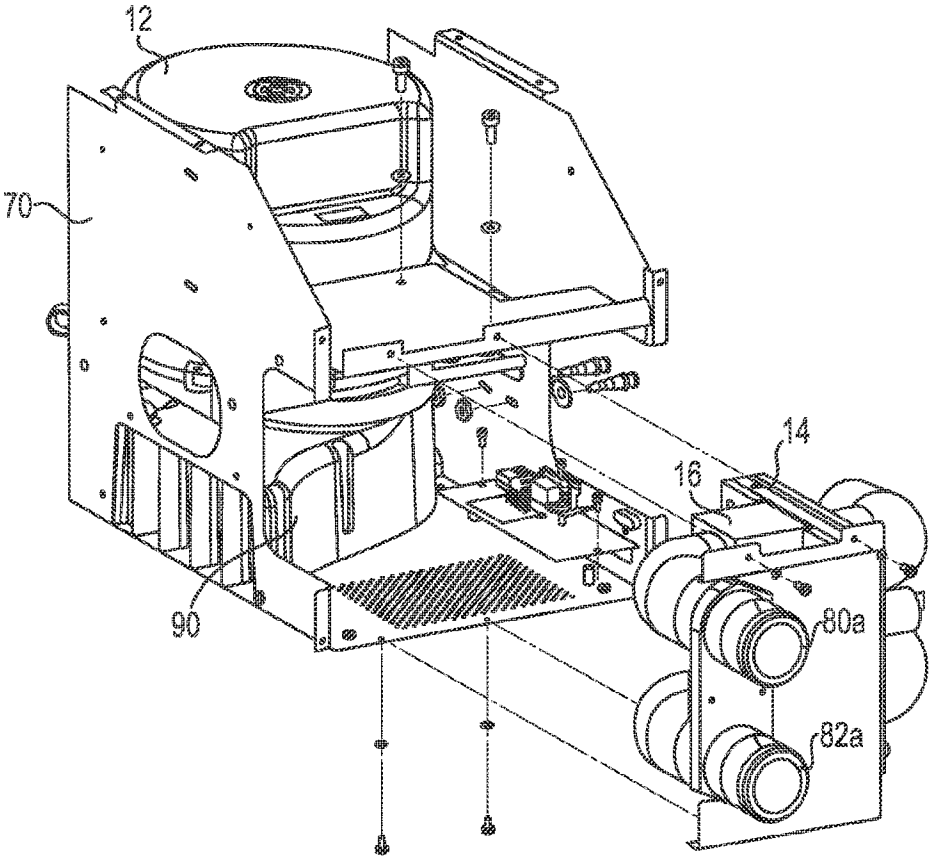
FIG. 3D is an alternate exploded view of the percussive pulsed air device of FIG. 1, according to one or more embodiments.
Figure 3E:
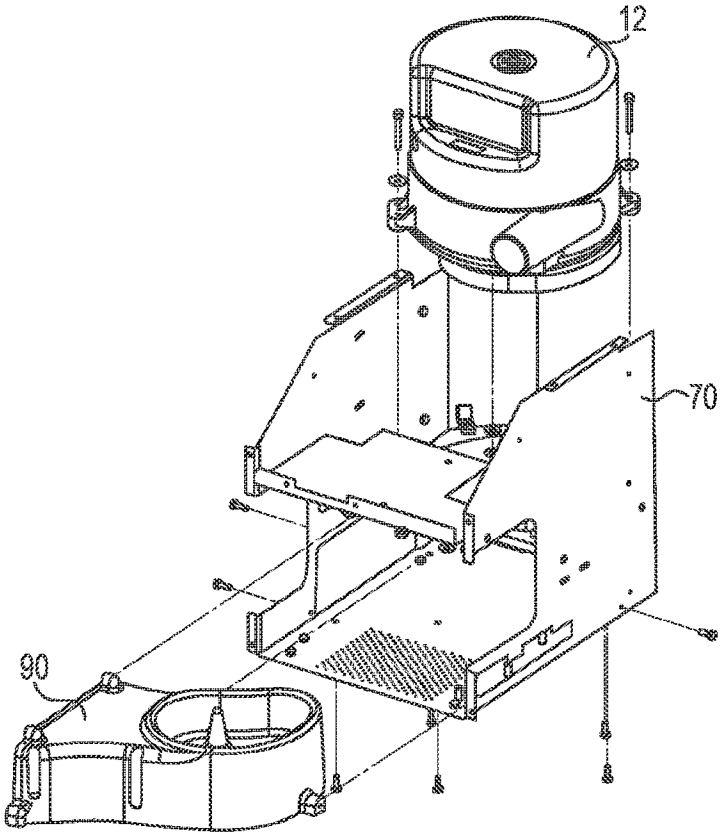
FIG. 3E is an alternate exploded view of the percussive pulsed air device of FIG. 1, according to one or more embodiments.
Figure 3F:
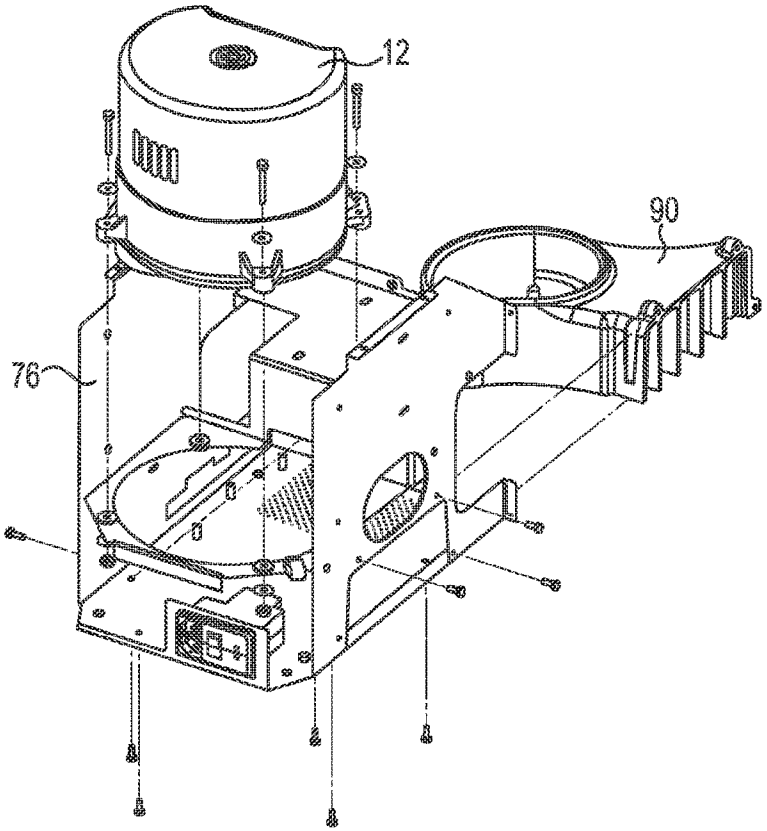
FIG. 3F is an alternate exploded view of the percussive pulsed air device of FIG. 1, according to one or more embodiments.

Turning now to FIG. 3A, the device 10 is shown in an exploded view, according to one or more embodiments, wherein top 72, back 71*b*, and side 78*a*, 78*b* portions are shown generally removed from the device to expose internal components. FIG. 3B shows a further exploded view of the device 10, wherein the front portion 71*a* is additionally removed from the device. FIGS. 3C-3F illustrate further exploded views of the device, with additional components removed. As shown, the device 10 may have a plenum 90, an air flow generator 12, a pulse frequency control module (or frequency control module) 14, and a pressure control unit 16, each arranged within the housing 70. FIGS. 3C and 3D show further exploded views of the device 10, wherein the pulse frequency control module 14 and pressure control unit 16 are removed from the device. FIGS. 3E and 3F show further exploded views of the device 10, wherein the plenum 90 and air flow generator 12 are removed from the device. Each of the air flow generator 12, plenum 90, pulse frequency control module 14, and pressure control unit 16 will now be described.

As shown in FIGS. 3A and 3B, an air flow generator 12 may generally be arranged within the housing 70, such as behind the back 71*b* portion of the housing, or at any other suitable location within the housing. The air flow generator 12 may be configured to provide air flow to a patient vest during a therapy session. The air flow generator 12 may be configured to receive air from the air intake 74 and/or the plenum 90. In some embodiments, the air flow generator 12 may be or include a compressor in an enclosed compartment having inlet and outlet ports. In other embodiments, the air flow generator 12 may be or include a fan or blower having fixed or variable speed. The air flow generator 12 may generally be controlled to adjust the amplitude of air pulses transmitted from the device 10 to the patient vest. In some embodiments, the air flow generator 12 may generally be flowably arranged between the air intake 74 (or plenum 90) and the pulse frequency control module 14, as shown for example in FIG. 3C.

The plenum 90 may generally be arranged between the airflow generator 12, such as an intake of the airflow generator, and the air intake 74 of the device 10. The plenum 90 may generally provide an air conduit between the air intake 74 and the airflow generator 12. In some embodiments, the plenum 90 may be configured to reduce sound generation by efficiently or effectively drawing air into the generator 12, as compared with an open fan inlet.

As shown in FIG. 3C, the air flow generator 12 may be flowably coupled to the pulse frequency control module 14 through ports 91*a* and 91*b*. Port 91*a* may allow airflow from the air flow generator 12 to enter the pulse frequency control module 14, whereas port 91*b* may allow air to flow from the pulse frequency control module back to the air flow generator and/or out to the atmosphere via an exhaust. It may be appreciated that in other embodiments, ports 91*a* and 91*b* may be reversed.

Figure 5:
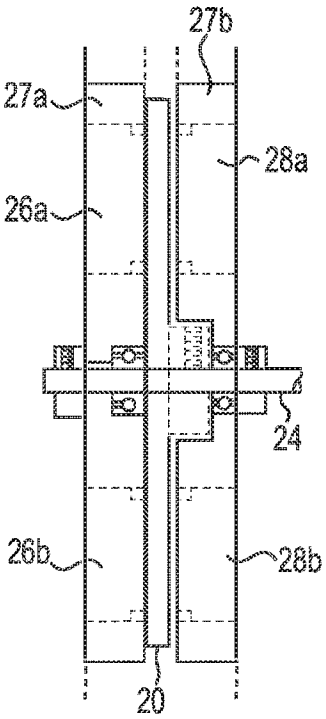
FIG. 5 is a side view of the frequency control module of FIG. 4, according to one or more embodiments.
Figure 4:
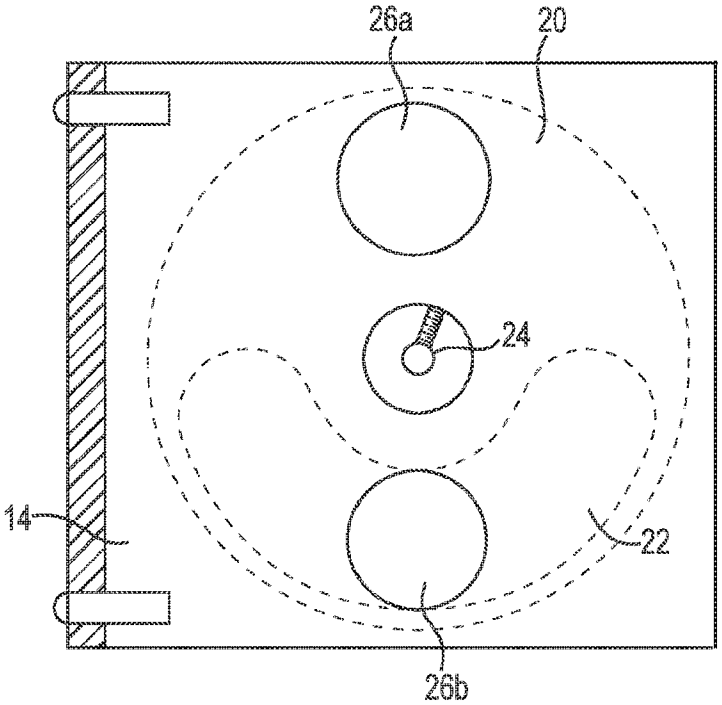
FIG. 4 is a front view of a frequency control module of the present disclosure, according to one or more embodiments.

The pulse frequency control module 14 may be configured to receive air from the air flow generator 12, and adjust the frequency or speed of the intermittent pulses being delivered to the patient vest during a therapy session. FIGS. 4 and 5 illustrate one embodiment of a pulse frequency control module 14. In some embodiments, the pulse frequency control module 14 may have one or more rotating fan-like blades 20 configured to rotate about a shaft 24. In some embodiments, the module 14 may have a single blade 20, while in other embodiments, the module may have two, three, four, or more blades rotating about an axis. Each blade 20 may have any suitable shape. For example, a blade 20 may have a circular shape with its center point arranged along the shaft 24. In other embodiments, a blade 20 may have a semi-circular shape. In still other embodiments, a blade 20 may have an elongated ovular shape with an end of the elongated shape arranged at the shaft 24. In other embodiments, other blade 20 shapes and/or arrangements may be provided.

Figure 6:
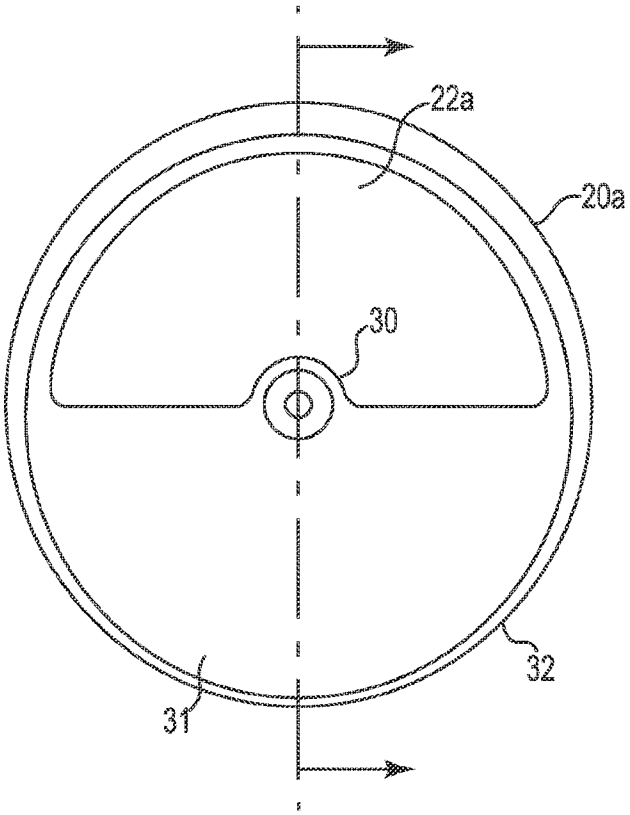
FIG. 6 is a front view of a blade and hub of the present disclosure, according to one or more embodiments.

In some embodiments, one or more blades 20 may have one or more cutout portions 22. Each cutout portion 22 may have any suitable shape. As shown for example in FIG. 4, in some embodiments, a circular blade 20 may have a rounded cutout portion 22 having a width extending across at least a portion of the blade's radius, between an outer perimeter of the blade and a center point of the blade. The cutout portion 22 may have a curved length extending radially around at least a portion of the blade. For example, the curved length may extend around approximately half of the circular blade 20. In some embodiments, the width and/or length may be configured to accommodate the diameter or width of an air port, such that air from the air port may pass through the cutout portion 22. FIG. 6 shows another embodiment of a circular blade 20*a* having a cutout portion 22*a*. As shown, the cutout portion 22*a* may extend between an outer perimeter of the blade and the point of rotation, and may have a generally semi-circular shape.

In some embodiments, the blade 20 may be arranged proximate to one or more air ports, such as air ports 26*a* and 26*b*. The cutout portion 22 may be configured to move across the air ports 26*a*, 26*b* as the blade 20 rotates on its central axis. The blade 20 may be adapted to periodically interrupt an air stream received from the air flow generator 12, wherein the cutout portion 22 allows air to pass through the pulse frequency control module 14 while the solid portion of the blade prevents, or interrupts, air from passing. During these interruptions, air pressure may build up behind the solid portion of the blade 20. When released through the cutout portion 22 of the blade 20, the air may travel as a pressure pulse to the patient vest. The resulting pulses can be in the form of fast rise, triangle wave pressure pulses. Alternative waveforms can be defined through alternate forms of cutout portions 22, alternate blade 20 arrangements, alternate number of blades, and/or through accurate control of blade 20, such as via an electronically controlled stepper motor. These pulses, in turn, can produce significantly faster air movement in the patient's lungs, in the therapeutic frequency range of about 5 Hz to about 25 Hz, as measured at the patient's mouth, according to some embodiments. In combination with higher flow rates into the lungs, as achieved using the present apparatus, these factors result in stronger mucus shear action, and thus more effective therapy in a shorter period of time.

As shown in FIG. 5, the blade 20 may be arranged about a centrally located shaft, such as a motor driven shaft, which may serve to rotate the blade, and in turn, provide airflow access to and through the air ports 26*a* and 26*b*. In some embodiments, the motor driven shaft 24 may be controlled by a stepper motor, for example. In other embodiments, other drivers or motors may operate the shaft 24. The blade 20 may be controlled to provide particular pressure waveforms to the patient vest. As additionally shown in FIG. 5, a pair of plates 27*a* and 27*b* may be mounted on an axis concentric with that of shaft 24, and effectively sandwich the blade assembly between the plates. The plates 27*a*, 27*b* may have corresponding air ports 26*a* and 26*b* (in plate 27*a*) and 28*a* and 28*b* (in plate 27*b*). The air ports may overlap such that air delivered from the external surface of either end plate 27*a*, 27*b* via an air port may be free to exit the corresponding air port in the opposite plate, at such times as the blade cutout portion 22 of the blade 20 is itself in an overlapping position therebetween. By virtue of the rotation of cutout portions 22 past the overlapping air ports 26*a*, 26*b*, in the course of constant air delivery from one air port toward the other, the rotating blade 20 may effectively function as a valve to permit air to pass into the corresponding air port in a semi-continuous and controllable fashion.

The pulse frequency control module 14 may be adapted (e.g., by configuring the dimensions, pitch, etc. of one or more fan blades 20 and/or cutouts 22) to provide wave pulses in a variety of forms, including sine waves, near sine waves (e.g., waves having precipitous rising and/or falling portions), triangular sine waves, and/or complex waves. As used herein a sine wave can be generally defined as any uniform wave that is generated by a single frequency, and in particular, a wave whose amplitude is the sine of a linear function of time when plotted on a graph that plots amplitude against time. The pulses can also include one or more relatively minor perturbations or fluctuations within and/or between individual waves, such that the overall wave form is substantially as described above. Such perturbations can be desirable, for instance, in order to provide more efficacious mucus production in a manner similar to traditional hand delivered chest massages. In some embodiments, the pulse frequency module 14 may be programmed and controlled electronically to allow for the automatic timed cycling of frequencies, with the option of manual override at any frequency.

Figure 7:
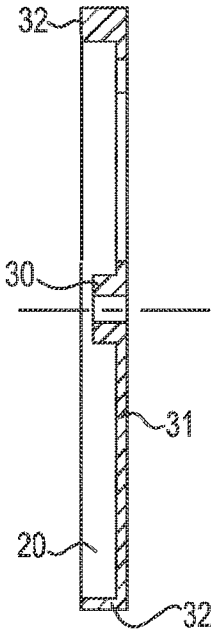
FIG. 7 is a side view of the blade and hub of FIG. 6, according to one or more embodiments.

In some embodiments, the one or more blades 20 may be arranged within or proximate to a housing. FIGS. 6-7 show another embodiment of the blade 20*a* having a cutout 22*a* and arranged within a housing. The blade housing may have a hub 30, a base plate element 31 and a variable thickness outer wall 32. The outer wall 32 may be thinner in the region generally opposite cutout portion 22*a*, and thicker proximate to the cutout portion. Particularly, the outer wall 32 thickness may be varied in order to statically and dynamically balance the fan blade 20*a*. By balancing blade 20*a*, a reduction in vibration and noise can be provided. One or more sensors, such as one or more Hall effect sensors, may be used with blade 20*a* or a valve motor to monitor and/or control rotational speed or frequency.

It may be appreciated that in other embodiments, the pulse frequency of the air provided to the patient vest may be provided by one or more other mechanisms, instead of, or in addition to, the one or more blades 20. For example, one or more electronically controlled valves may operably allow air to pass between the frequency control module 14 and pressure control unit 16. Electronically controlled valves(s) may allow for increased precision in the timing of airflow in some embodiments, which may allow for precision in overlapped opening of valves, or lack thereof, as desired. Other mechanical and/or electrical mechanisms are contemplated by the present disclosure as well.

Figure 8:
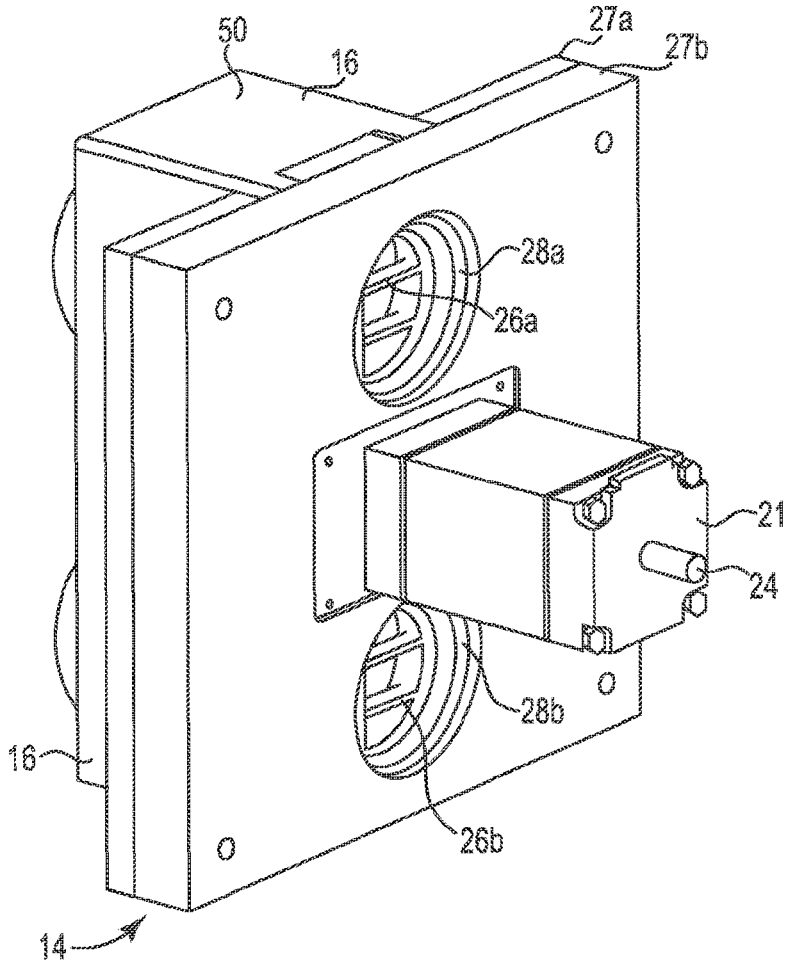
FIG. 8 is a perspective view of a frequency control module and pressure control unit of the present disclosure, according to one or more embodiments.
Figure 9:
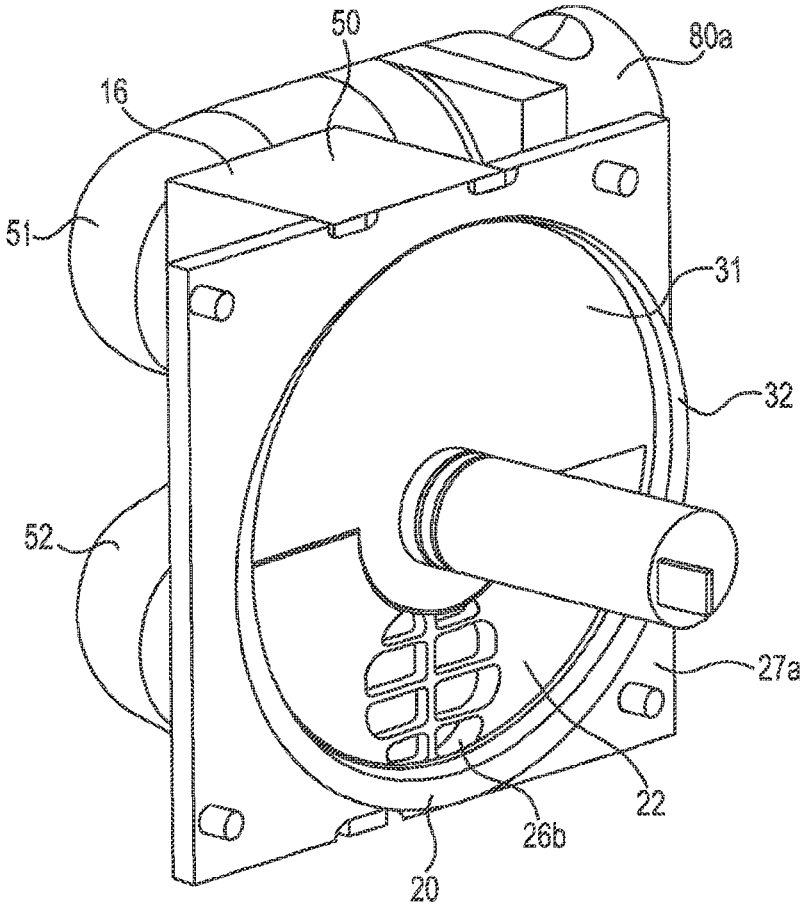
FIG. 9 is a perspective view of a portion of the frequency control module and the pressure control unit of FIG. 8, according to one or more embodiments.

FIG. 8 illustrates the pulse frequency control module 14 flowably coupled to the pressure control unit 16. The pressure control unit 16 may be coupled to the plate 27*a* in some embodiments, for example. As shown, the frequency control module 14 may interact with air flow received, for example from the air flow generator 12, before the air flow enters the pressure control unit 16. FIG. 8 further illustrates the arrangement of motor 21 in communication with the frequency control module 14. FIG. 9 further shows the pulse frequency control module 14 and pressure control unit 16 with the plate 27*b* and motor 21 removed. Outlets 51, 52 may be arranged between the pressure control unit 16 and the external ports 80*a*, 82*a*, for example, in order to direct air from the pressure control unit to the patient vest.

In some embodiments, the pressure control unit 16 may have a balancing chamber/manifold 50 in communication with ports 26*a* and 26*b* of module 14. The pressure control unit 16 may be adapted to receive or pass air through ports 26*a* and 26*b* of pulse frequency control module 14, and effectively provide a manifold or air chamber to deliver air to the patient vest. During operation, the pressure control unit 16 may receive air pulse pressure waves through ports 26*a*, 28*a*. In some embodiments, an atmospheric vent may be coupled to port 28*b* of the frequency control module 14. The atmospheric vent may be closed to the atmosphere when port 26*a* is open, and may be open to the atmosphere when port 26*a* is closed. The pressure control unit 16 may be active or passive. For example, an active pressure control unit 16 may include, for example, valves and electric solenoids in communication with an electronic controller, microprocessor, etc. A passive pressure control unit 16 may include a manual pressure relief or, in a simple embodiment, the pressure control unit may include only the air chamber providing air communication between the air lines extending to the patient vest and not otherwise including a pressure relief or variable pressure control.

While the percussive pulsing therapy device 10 has been generally described above, a device of the present disclosure may be more specifically described in U.S. Pat. No. 7,597,670, entitled "Chest Compression Apparatus, and filed Aug. 15, 2015; U.S. Pat. No. 6,958,046, entitled "Chest Compression Apparatus, and filed Jan. 2, 2002; U.S. Pat. No. 7,762,967, entitled "Chest Compression Apparatus," and filed Sep. 12, 2006; and/or U.S. Patent Publication No. 2007/0225612, entitled Metabolic Measurement System Including a Multiple Function Airway Adapter, filed Feb. 1, 2007, the contents of each of which are hereby incorporated by reference herein in their entirety.

Figure 10:
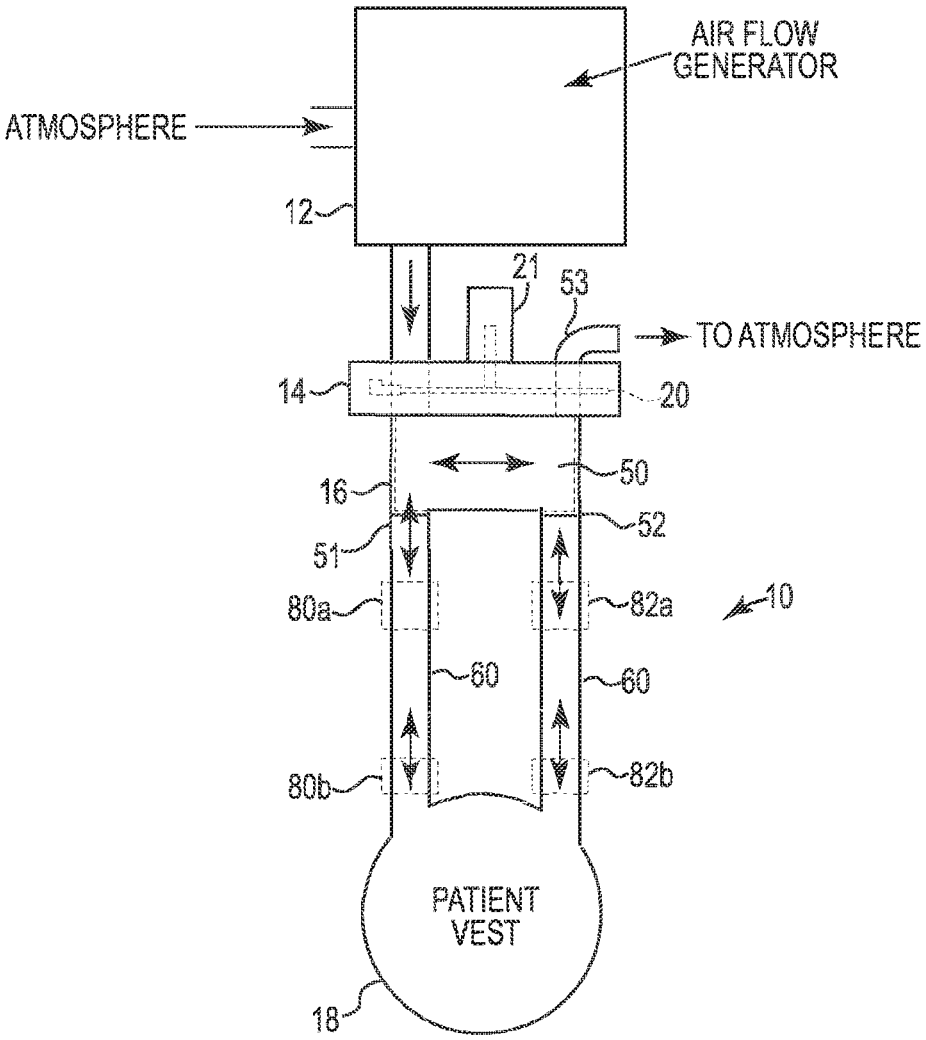
FIG. 10 is a flow diagram of a percussive pulsed air device of the present disclosure, according to one or more embodiments.

FIG. 10 shows an air flow diagram associated with the percussive pulsing therapy device 10 of the present disclosure, according to one or more embodiments. As shown, the device 10 may have an air flow generator 12 that draws air from the atmosphere. Air from the air flow generator 12 may flow to a frequency control module 14 having a rotating blade 20 or other valve. The rotating blade 20 may be powered by motor 21. The frequency control module 14 may further have a vent 53 for releasing air back to the atmosphere. From the frequency control module 14, air may travel in the device 10 to a pressure control unit 16. The pressure control unit 16 may have a balancing chamber/manifold 50. From the pressure control unit 16, air may travel through outlets 51 and 52, and pass through ports 80*a* and 82*a* into airways 60 before reaching a patient vest 18 through ports 80*b* and 82*b*. Generally, the patient vest 18 may have a bladder, which may fill or partially fill with the air entering the vest. Air leaving the vest 18 may travel through ports 80*b* and 82*b* and airways 60. Air in the device 10 may be recirculated back to the pressure control unit 16 at outlets 51 and 52. Alternatively, in some embodiments, a single outlet 51 may be used for air to travel from the balancing chamber/manifold 50 to port 80*a*, through airway 60, and into the patient vest 18 through port 80*b*. In such embodiments, air leaving the patient vest 18 may return through port 80*a* and recirculate back to the pressure control unit 16 via airway 60 and outlet 51.

Relocated Inlet and Outlet Ports

In some embodiments, inlet and outlet ports of the frequency control module 14 and/or pressure control unit 16 may be located or arranged to improve system performance. Generally, where air flow passes between the frequency control module 14 and pressure control unit 16, inlet ports 26*a*, 28*a* and outlet ports 26*b*, 28*b* may be aligned with one another. For example, as shown in FIG. 8, ports 28*a* and 26*a* of plates 27*a* and 27*b* may be aligned with one another, such that air entering port 28*a* may flow directly through port 26*a* and into the pressure control unit 16. Similarly, ports 28*b* and 26*b* of plates 27*a* and 27*b* may be aligned with one another, such that air entering port 26*b* from the pressure control unit 16 may flow directly through port 28*b*. In this way, the inlet ports for air passing between the frequency control module 14 and pressure control unit 16 may be arranged on the same plane. Likewise, outlet ports for air passing between the module 14 and pressure control unit 16 may be arranged on the same plane. In some embodiments, one or more of the inlet and/or outlet ports surrounding the blade 20 or otherwise positioned between the frequency control module 14 and pressure control unit 16, may be arranged differently, such that one of the inlets and/or outlets may be located on a different plane than its corresponding port.

Figure 11:
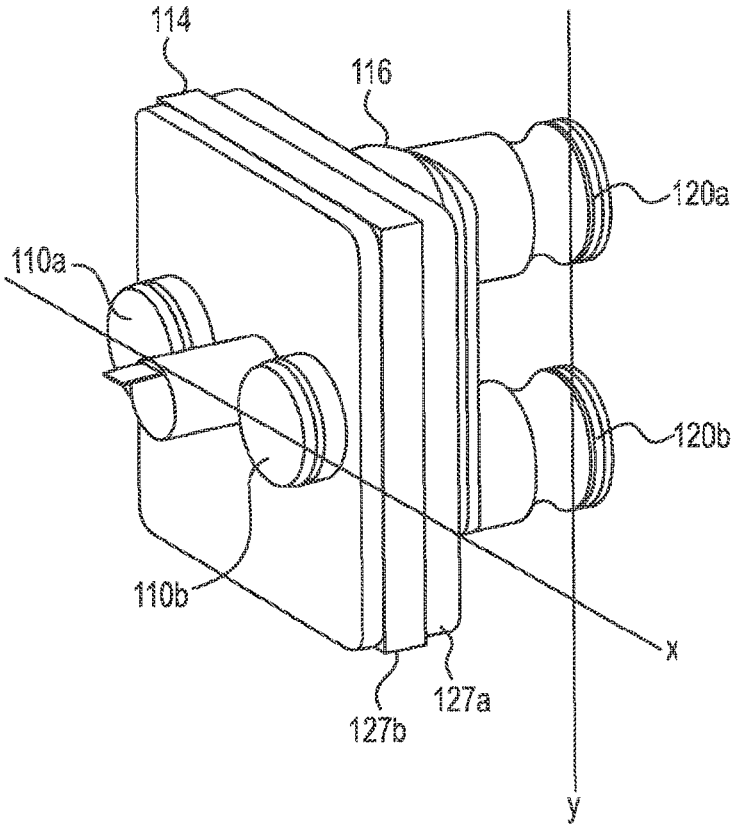
FIG. 11 is a perspective view of a frequency control module and pressure control unit of the present disclosure, according to one or more embodiments.
Figure 12:
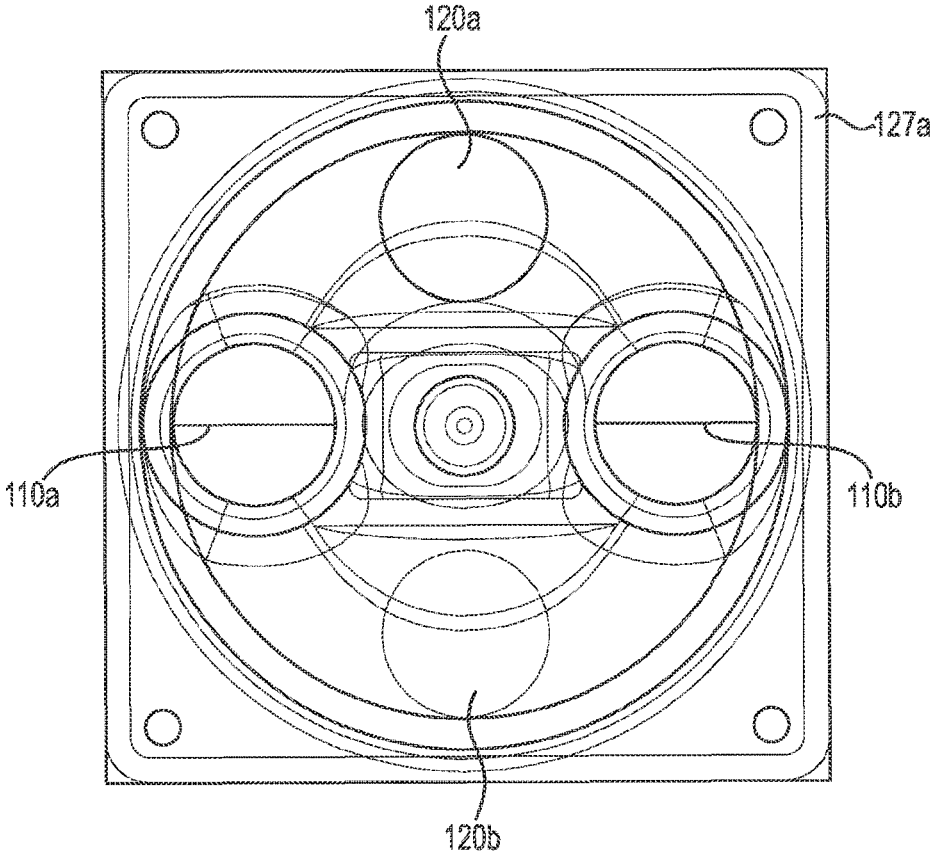
FIG. 12 is an internal view of the frequency control module and pressure control unit of FIG. 11, according to one or more embodiments.

FIGS. 11 and 12 illustrate one embodiment of repositioned inlet and/or outlet ports. A frequency control module 114 and pressure control unit 116 of a percussive pulsed air device of the present disclosure are shown. The frequency control module 114 may have two plates 127*a*, 127*b*, which may be arranged on either of two sides of a blade, such as blade 20 discussed above. The plate 127*b* may provide two frequency control module ports 110*a*, 110*b*, through which air may pass between the frequency control module 114 and an air flow generator, for example. For example, in some embodiments, port 110*a* may be an inlet port for air entering the frequency control module 114 from an air flow generator, and port 110*b* may be an outlet port for air exiting the frequency control module to an air vent, an evacuator, or other location. The plate 127*a* may be coupled to the pressure control unit 116. The pressure control unit 116 may have two pressure control unit ports 120*a*, 120*b* through which air may pass between the pressure control unit 116 and a patient device, such as a vest. In some embodiments, the pressure control unit ports 120*a*, 120*b* may be inlet and/or outlet ports, wherein air may travel in either direction through the ports. In other embodiments, ports 120*a*, 120*b* may extend from the plate 127*a*.

In some embodiments, the frequency control module ports 110 may be arranged out of alignment with the pressure control unit ports 120. For example, as shown in FIGS. 11 and 12, the pressure control unit ports 120 may be rotated approximately 90 degrees from the frequency control module ports 110. That is, the pressure control unit ports 120*a*, 120*b* may be arranged on a generally different plane than the frequency control module ports 110*a*, 110*b*. For example, as shown in FIG. 11, the frequency control module ports 110 may be positioned on a plane x, defined between the centerpoints of the two ports. The pressure control unit ports 120 may be positioned on a different plane y, defined between the centerpoints of the two ports. In some embodiments, plane y may be perpendicular to plane x. In other embodiments, the two planes may be arranged differently with respect to one another. For example, in some embodiments, planes x and y may be separated by approximately 45 degrees or a different angle. In still other embodiments, the ports 110, 120 may be arranged in other configurations. For example, in some embodiments, the frequency control module ports 110*a*, 110*b* may be arranged on different planes from one another, and/or the pressure control unit ports 120*a*, 120*b* may be arranged on different planes from one another. In still other embodiments, plate 127*a* may extend further outward from frequency control module 114 to form a chamber configurable to enhance mixing and/or airflow characteristic.

This alternate configuration of the frequency control module ports 110 and the pressure control unit ports 120 may provide various benefits. For example, air in the device may be more efficiently and/or effectively mixed. When the frequency control module ports 110 are arranged on a same plane with the pressure control unit ports 120, ineffective air mixing may result. For example, there may be a bias for warmer air within the device to preferentially feed one or more of the pressure control unit ports. Air may be heated by mechanical operations within the device, proximity to the user, and/or other components. The temperature differential may be as much as 5-15 degrees Celsius in some embodiments. With this temperature bias, hotter air may migrate to one side of the patient vest, which may cause discomfort for users, leading to decreased adherence. This ineffective air mixing may also have an impact on delivered pulse pressures over a wide frequency range associated with the device. For optimal outcomes, a uniform pulse is desirable so portions of the anatomy are not neglected during therapy. By reconfiguring the frequency control module ports 110, pressure control unit ports 120, the contours of surface 128 of plate 127*a*, or any combination thereof, air within the device may be more effectively and/or efficiently mixed within the device. By improving mixing of the air in the device, a more uniform pulse may be delivered. This may be even more important as the device is used across a wide range of vest volumes. A uniform air mixture may mitigate variability introduced when using different size vests.

Figure 13:
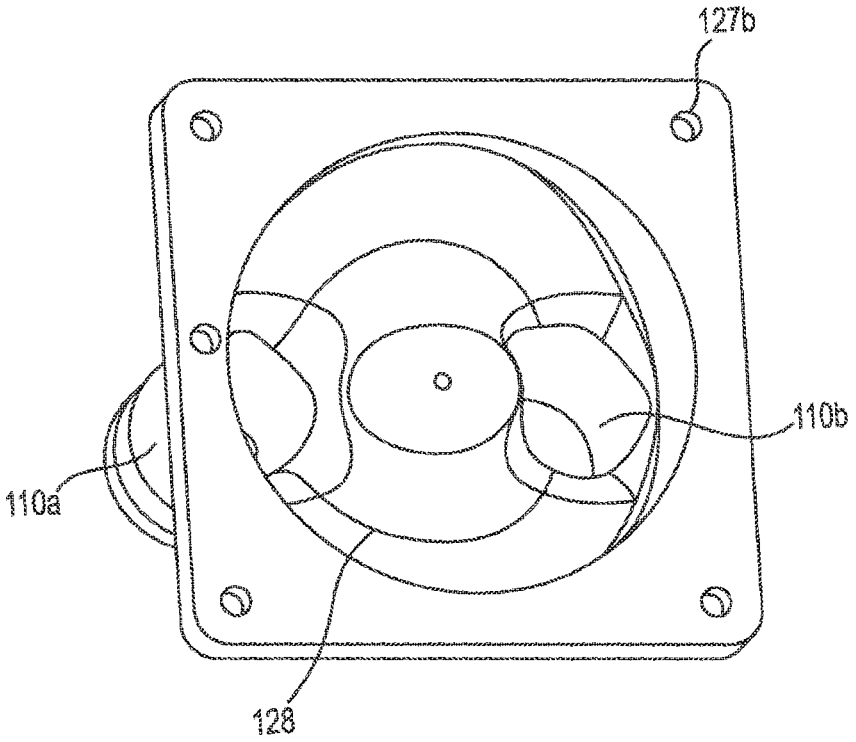
FIG. 13 is an internal view of a portion of the frequency control module of FIG. 11, according to one or more embodiments.

In some embodiments, as shown for example in FIG. 13, contours may be provided on an interior surface 128 of plate 127*a* of the frequency control module 114, so as to help improve airflow mixing and/or delivery. The contours may include sloped, angled, and/or stepped surfaces along the interior surface. In some embodiments, similar contouring may be provided on an interior surface of the plate 127*b*. For example, contours on the interior surface 128 may provide a curved transition from the interior surface to the one or more ports, such as pressure control unit ports 120*a*, 120*b* and/or frequency control module ports. Such contours may, for example, provide for a smoother flow to and from the patient vest and therefore may allow for a generally more efficient transfer of pressure and/or consistent wave profile. Symmetry of contours may provide for improved mixing of air within the frequency control module 114 and/or pressure control unit.

Additionally, it may be appreciated that a well-mixed air volume may allow better thermal management of the hardware system used to deliver the pulsed air to the vest. Excess heat in the system can stress the device hardware and lead to premature failure of electrical and/or mechanical components. Improved mixing of the system air can more evenly distribute the heat and avoid any hot spots.

Deadhead Mitigation

In some embodiments, one or more blades of a frequency control module may be designed to mitigate deadheading. As described above with respect to FIG. 4 for example, a blade 20 of a frequency control module 14 may have one or more cutouts 22, allowing air to pass through the blade. As the blade 20 rotates, pressurized air being pumped into the frequency control module 14 may be intermittently stopped behind a closed portion of the blade and then released through a cutout 22 portion of the blade. Deadheading may occur when the pressurized air is blocked by a closed portion of the blade. In some embodiments, this may occur approximately 50% of the time in the device. In other embodiments, deadheading may occur for a different portion of the time, based on blade configuration and other factors. Deadheading may lead to increased heat in the device, more acoustical noise, and/or inefficient power management.

Figure 14A:
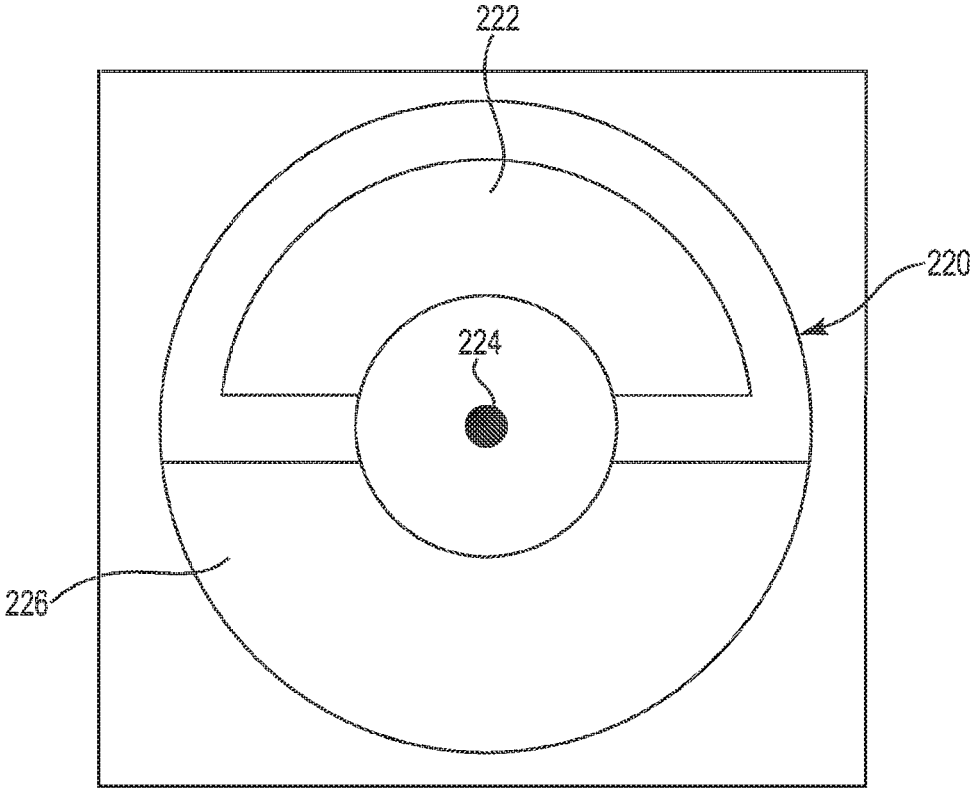
FIG. 14A is a front view of a blade of the present disclosure, according to one or more embodiments.

FIG. 14A illustrates one embodiment of a modified blade 220 of a frequency control module. As shown, the blade 220 may have one or more cutout portions 222, similar to the blade 20 described above. The blade 220 may be configured to rotate about a central axis 224. Additionally, the blade 220 may have a channel, such as a dado channel 226. The dado channel 226 may be arranged on one face or side of the blade 220, such that the channel is not a cutout allowing air to pass through the blade. For example, in one embodiment, the dado channel 226 may be arranged on a side of the blade 220 that faces an air flow generator of the device. In this way, when air from the air flow generator is directed toward the blade 220, as the blade rotates on its axis 224, the pressurized air may alternatively be passed through the cutout portion 222 and redirected via the dado channel 226. The dado channel 226 may operate to redirect air toward an outer edge of the blade 220. In this way, the air may be directed to a circumferential portion of the blade 220 housing where the air may be ducted out in some embodiments.

The channel 226 may extend from a perimeter of the blade 220, and may have a width extending between the perimeter and the blade's rotational axis. The width of the channel 226 may be configured to allow air from an air port to be directed into the channel. The channel 226 may have any suitable curved length extending radially around the blade 220. In some embodiments, as shown for example in FIG. 14A, the channel may have a length extending around approximately half of the blade 220.

Figure 14C:
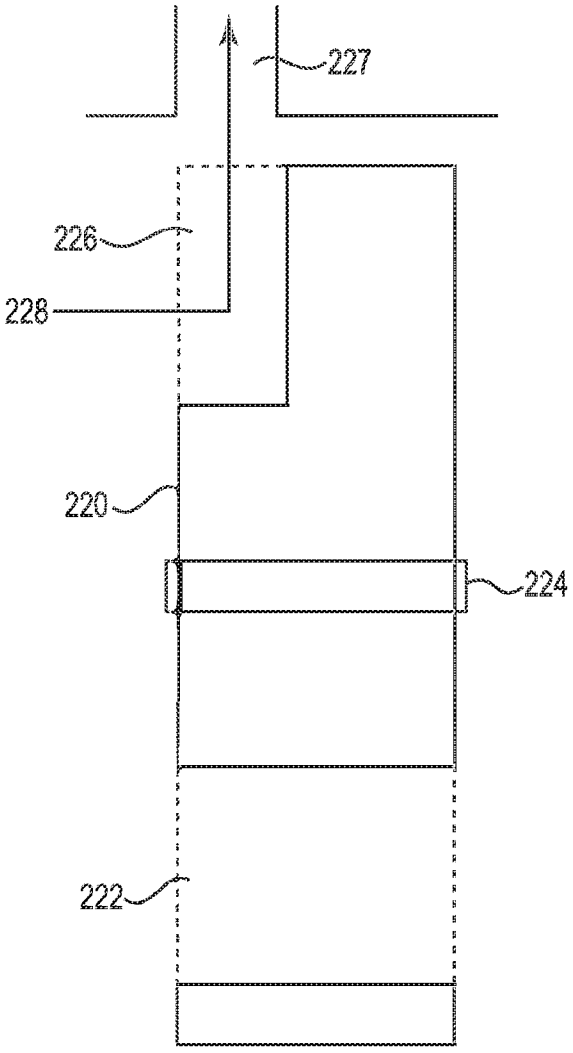
FIG. 14C is a side view of the blade of FIG. 14A in a second position, according to one or more embodiments.
Figure 14B:
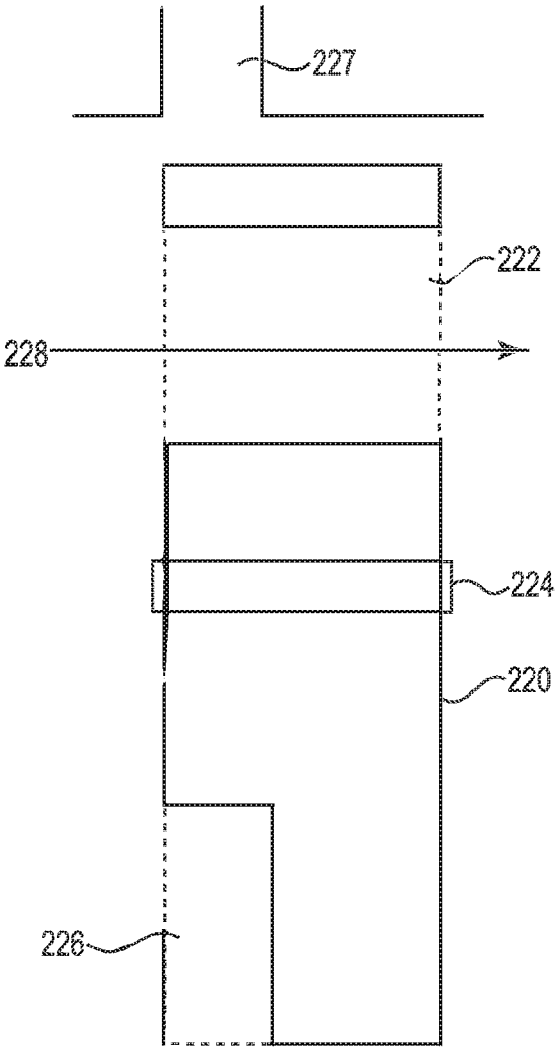
FIG. 14B is a side view of the blade of FIG. 14A in a first position, according to one or more embodiments.

FIGS. 14B and 14C show the blade 220 in a first and second rotational positions, respectively. FIG. 14B shows the blade in a first rotational position, allowing air flow 228 from the air flow generator to pass through the blade 220 via the cutout 222, such that the air may pass through to the frequency control module and/or patient vest. FIG. 14C illustrates the blade 220 in a second rotational position, rotated 180 degrees from the first position, allowing air flow 228 from the air flow generator to pass through the dado channel 226 and be routed through the a vent 227 to the atmosphere or an inlet of the air flow generator. As the blade 220 spins on the axis 224, it may rotate between the first and second positions. In this way, the blade 220 may mitigate deadhead buildup behind the blade 220.

Figure 16:
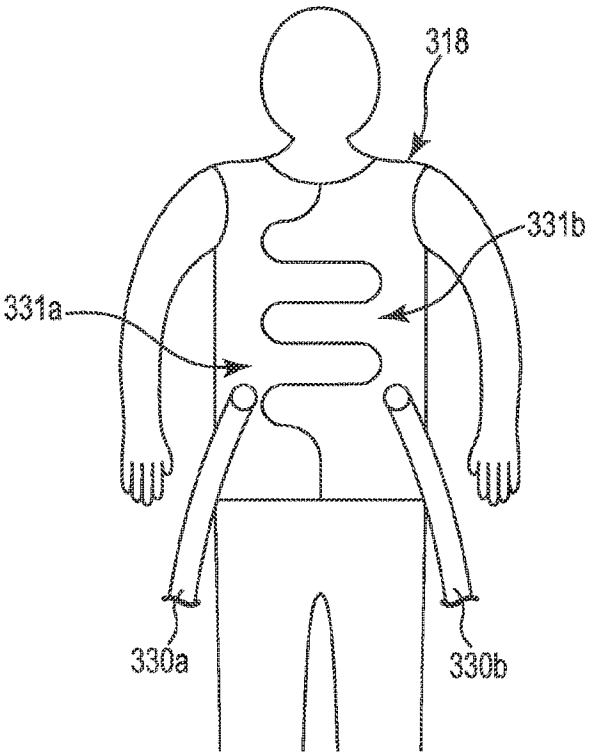
FIG. 16 is a front view of a patient vest that may operate with the blade of FIG. 15, according to one or more embodiments.
Figure 15:
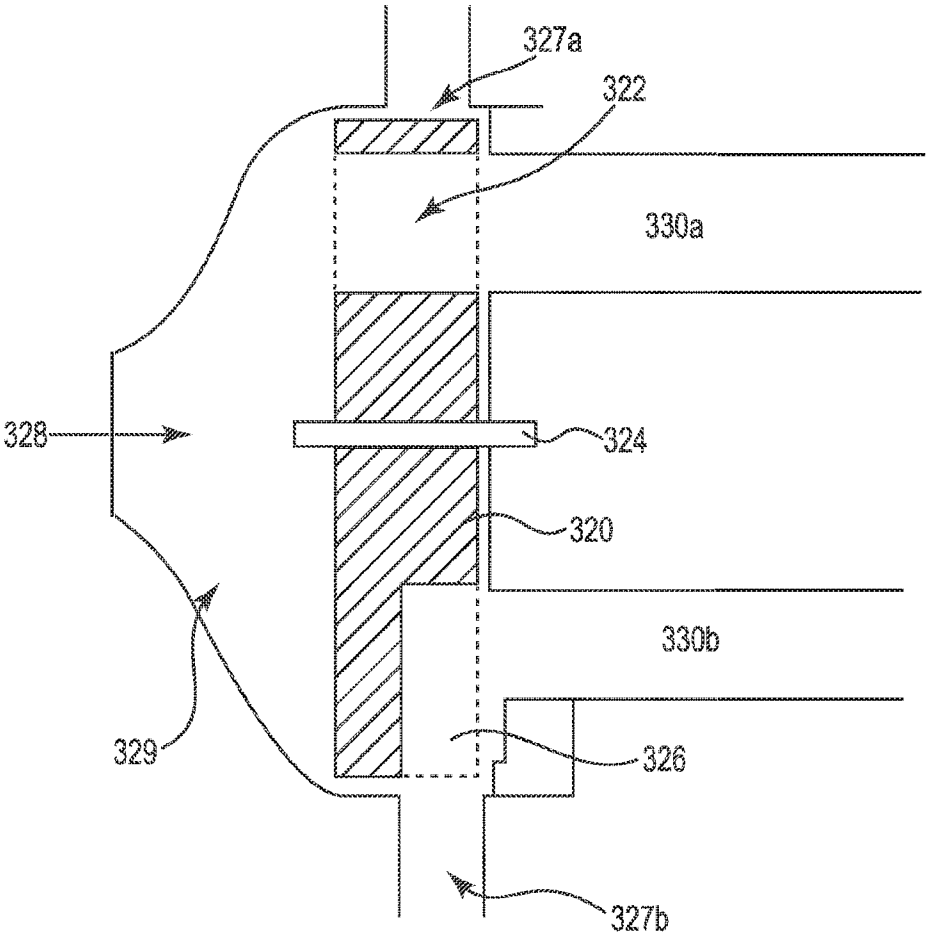
FIG. 15 is a side view of a blade of the present disclosure, according to one or more embodiments.

FIG. 15 illustrates another embodiment of a blade 320 configured to rotate about a central axis 324. As shown in FIG. 15, the blade 320 may generally have a reverse arrangement, compared to the blade 220 discussed above. That is, for example, the blade 320 may have a channel, such as a dado channel 326, arranged on a side of the blade that faces a frequency control module and/or patient vest. The blade 320 may additionally have a cutout portion 322. The blade 320 may be arranged in a housing coupled to one or more ports or tubes. For example, as shown in FIG. 15, the blade housing may couple to two tubes 330*a*, 330*b*. The tubes 330*a*, 330*b* may flowably couple to a patient vest 318, as shown according to one embodiment in FIG. 16. In some embodiments, the patient vest 318 may have two portions 331*a*, 331*b*. Portion 331*a* may couple to tube 330*a*, and similarly, portion 331*b* may couple to tube 330*b*. In some embodiments, the two portions 331*a*, 331*b* of the vest 318 may be arranged generally vertically with respect to one another, generally horizontally with respect to one another, or may have any other suitable arrangement. In some embodiments, for example, the two portions may be divided into front and rear portions. The vest 318 may have more or fewer portions in some embodiments.

Turning back to FIG. 15, air flow 328 from an air flow generator may enter a plenum 329 and be directed toward the blade 320. The blade 320 may generally rotate between a first position and a second position. In the first position, shown in FIG. 15, air flow 328 may pass through the cutout 322, and may be directed to a portion 331*a* of the patient vest 318 via tube 330*a*. When the blade 320 rotates 180 degrees to a second position, air evacuating the first portion 331*a* of the vest 318 may enter the dado channel 326 and be routed through a vent 327*a* to the atmosphere and/or back to an inlet at the air flow generator. Simultaneously, air flow 328 from the air flow generator may be directed through cutout 322 to enter the vest portion 331*b* via tube 330*b*. When the blade 320 rotates again to the first position, air from the vest portion 331*b* may be evacuated via the tube 330*b* through vent 327*b*, while air flow 328 is again passed through the cutout 322 to the vest portion 331*a* via tube 330*a*. In this way, it may be appreciated that the blade 320 may provide for air flow 328 entering one portion of the vest 318, while simultaneously evacuating a second portion of the vest. In other embodiments, the blade 320 may have additional cutouts 322 and/or channels 326. Moreover, the vest 318 may have more or fewer portions, such that one or more portions of the vest may be provided with pulsed air, while one or more portions of the vest are simultaneously evacuated.

In still other embodiments, rather than a mechanical blade controlling air flow, one or more electronic valves may be used, as described above. As described above, electronically controlled valves may allow for increased precision in timing of the valve opening(s), for example. This may help to reduce deadheading. For example, in at least one embodiment, one or more valves may divert deadhead pressure to a reservoir.

Figure 17A:
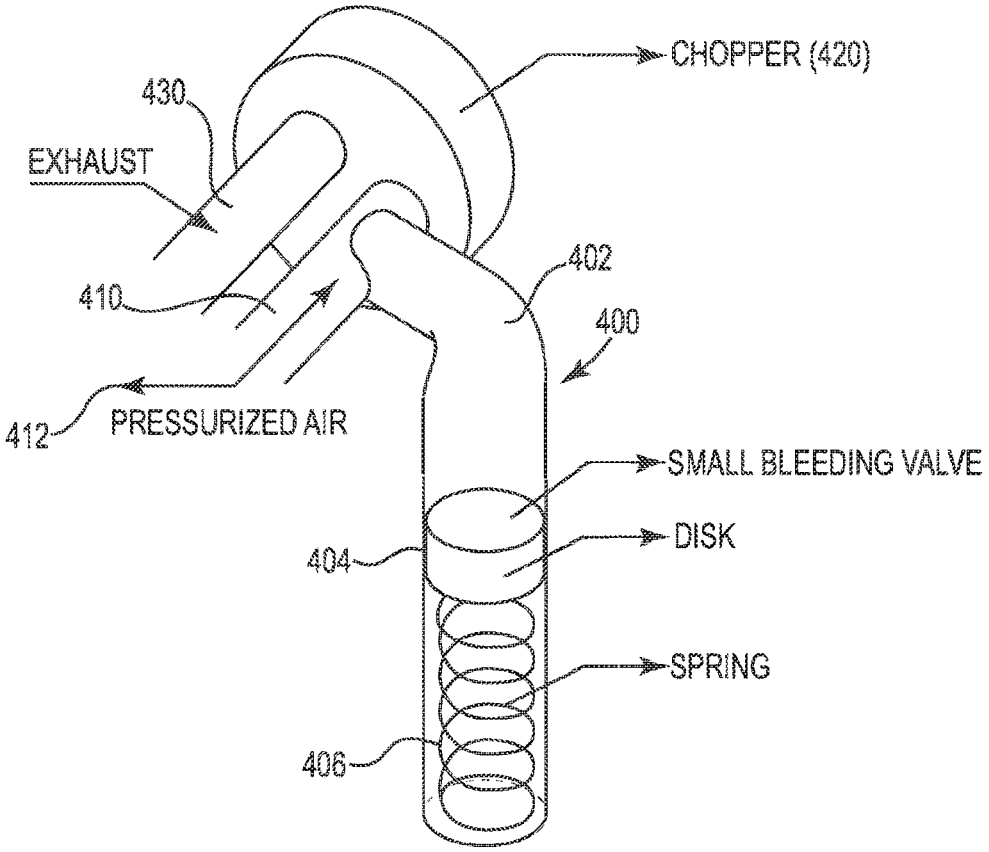
FIG. 17A is a perspective view of a dampening element of the present disclosure, according to one or more embodiments.

In still other embodiments, a percussive pulsed air device of the present disclosure may have a dampening element configured to help mitigate deadheading, noise, energy draw, and/or shock. FIG. 17A illustrates one embodiment of a dampening element 400 coupled to a pressurized air port 410. The pressurized air port 410 may direct pressurized air 412 to a frequency control module 420, and ultimately to a patient vest. An exhaust port 430 may vent air released from the vest. The dampening element may have a disk 404 and spring 406 arranged within a chamber 402.

The chamber 402 may flowably couple to the pressurized air port 410. The chamber 402 may be configured to redirect or collect pressurized air 412 when the frequency control module 420 is blocked (such as when a solid portion of a blade prevents air from passing through the frequency control module). The chamber 402 may have any suitable size configured to accommodate the amount of pressurized air buildup between cycles of the frequency control module 420. The chamber 402 may additionally have any suitable shape. For example, the chamber 402 may have a cylindrical shape in some embodiments. In other embodiments, the chamber 402 may have any other suitable shape.

The disk 404 may be arranged between the pressurized air port 410 and the spring 406, and may generally be configured to compress the spring 406 in response to pressurized air 412. The disk 404 may be configured to move within the chamber 402. For example, the disk 404 may be configured to move vertically within the chamber 402 in response to the pressurized air 412. The disk 404 may have any suitable size and/or shape. For example, where the chamber 402 has a generally cylindrical shape, the disk 404 may have a rounded shape with a diameter similar to that of the cylindrical chamber, while still allowing the disk to slide axially within the chamber. The spring 406 may be configured to compress in response to movement of the disk 404. The spring 406 may have any suitable size and stiffness configured to respond to the pressurized air 412.

When the pressurized air 412 is blocked or partially blocked at the frequency control module 420, for example, where a closed portion of a blade generally prevents air from passing through the frequency control module, the dampening element 400 may act to relieve at least a portion of the deadhead pressure by redirecting the pressurized air to the chamber 402. In the chamber 402, the pressurized air 412 may push the disk 404 against the spring 406, causing the spring to compress. When the frequency control module 420 permits air to pass therethrough, such as when a cutout portion of a blade passes across the pressurized air port 410, the pressurized air stored in the chamber 402 may be directed through the frequency control module 420. As a result, the spring 406 may decompress, extending the disk 404 to its starting position.

The spring may thus preserve energy of the pressurized air 412 until the frequency control module 420 allows the pressurized air to pass therethrough. In this way, the dampening element 400 may preserve the energy of the pressurized air 412 to be used in a next pulse wave cycle in some embodiments. It may be appreciated that the dampening element 400 may operate with different valve or frequency control module configurations as well, including other mechanical valves and/or electronic valves. In other embodiments, the dampening element 400 may operate using gravitational forces in addition to or alternative to the spring 406. For example, the chamber 402 may be arranged such that the disk 404 may fall due to force of gravity when it is not subject to pressurized air 412, and may raise upward when pressurized air enters the chamber.

Figure 17B:
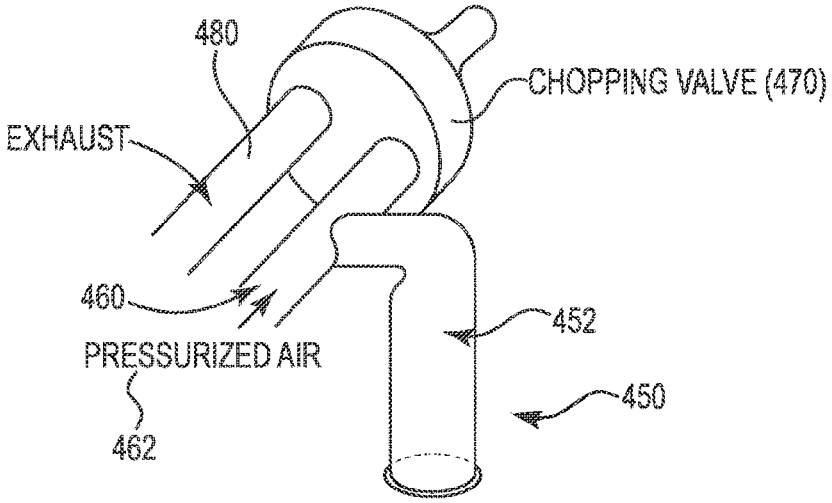
FIG. 17B is a perspective view of another dampening element of the present disclosure, according to one or more embodiments.

In another embodiment, shown for example in FIG. 17B, a dampening element 450 may provide a chamber 452 sized to receive pressurized air 562, such that a spring and disk may not be needed. As with the dampening element 400, the dampening element 450 be arranged with its chamber 452 flowably coupled to a pressurized air port 460. The pressurized air port 460 may direct pressurized air 462 to a frequency control module 470, and ultimately to a patient vest. An exhaust port 480 may vent air released from the vest through the frequency control module 470.

The chamber 452 may have any suitable shape and size configured to receive a quantity of pressurized air 462 when the frequency control module 470 is blocked or partially blocked to prevent the pressurized air from passing therethrough. The chamber 452 may have a volume configured to provide a suitable resistance to the pressurized air 462. In some embodiments, the volume of the chamber 452 may be configurable and/or modifiable. In some embodiments, the volume of the chamber 452 may be configured to change dynamically. For example, it may be desirable to modify the chamber 452 volume based on measured noise, vibration, accelerometer readings, and/or other components. Active mechanisms for tuning the chamber volume may include, but are not limited to, a motor such as a stepper motor, a gated valve, a spring and disk, or combinations thereof.

The above deadhead mitigation techniques, alone or in combination, may result in improved performance of the percussive pulsed air device. For example, heat stress may be reduced. Additionally or alternatively, the above mitigation techniques may lead to reduced noise of the device. This may also lead to more operating efficiency, longer life of components, lower maintenance costs, and/or lower manufacturing costs. In some embodiments, non-pulsing air, such as air redirected by a dado channel, as described above, or collected by a dampening element, may be used to cool device components.

Noise Mitigation

In some embodiments, a percussive pulsed air device of the present disclosure may have various means for reducing operation noise. For example, in some cases, an air flow generator can be a significant noise source in a percussive pulsed air device. In some embodiments, an air flow generator of a percussive pulsed air device of the present disclosure may be inverted, as compared with the air flow generator 12 described above with respect to FIGS. 1-3F, so as to position the noise source lower in the device. In some embodiments, the air flow generator may be partially or entirely encased in molded foam or other materials. Additionally or alternatively, in some embodiments, a filter media may be arranged on one or more air outlets or exhaust outlets of the device to dampen noise. Still further, one or more outlets of the percussive pulsed air device may be shaped or arranged such that noise created at or passed through the outlet may be directed generally downward, so as to direct the resulting noise downward. Furthermore, air inlets or outlets, including an exhaust manifold for example, may be comprised of a channel lined with sound absorbing material such as foam to mitigate noise communicated to the environment.

In some embodiments, a percussive pulsed air device of the present disclosure may additionally have various means for mitigating noise created within or passing through one or more hoses, airways, or conduits of the device, such as hoses arranged between the device and patient vest. For example, in at least one embodiment, one or more hoses or lines may have an interior surface and/or exterior surface coated or sleeved in fabric, foam, or another suitable acoustically absorbent material. Additionally or alternatively, one or more hoses or lines may have a section or multiple sections shaped or configured to disrupt the sound within the line. As an example, one or more lines may have an S-shaped section in some embodiments. Additionally or alternatively, in some embodiments, one or more lines or hoses may be configured to provide a relatively smooth and/or gradual transition between components. Additionally or alternatively, in some embodiments, one or more lines or hoses may have a porous plug or disk arranged therein, such as a porous foam plug having a cross sectional area that same as, or similar to, that of the line or hose. For example, a porous foam plug having a width or diameter the same as, or similar to, that of a line or hose may be arranged within the line or hose. For example, a line extending between the percussive pulsed air device and a patient vest may have a porous foam plug arranged near a port of the device and/or near a port of the vest. Similarly one or more porous plugs or disks may be arranged within one or more ports, inlets, or outlets of a percussive pulsed air device of the present disclosure to mitigate noise.

High Temperature Mitigation

In some embodiments, a percussive pulsed air device of the present disclosure may have various means for mitigating heat within the device or a patient device. Heated air may not only be uncomfortable for a user, it may also wear down components within the device, and in some embodiments may be caustic. For example, a blower or compressor of an air flow generator may have ducting, such as molded foam ducting, so as to allow the blower or generator to cool. Further, in some embodiments, heated air from within the device may be directed out to ambient air rather than internally within the device. The redirection may occur at or near the frequency control module.

Contaminant Mitigation

In some embodiments, a percussive pulsed air device of the present disclosure may have various means for mitigating contaminants within the device. For example, circulated air from within the device may be directed out to ambient air rather than internally within the device. The redirection may occur at or near the frequency control module. Additionally or alternatively, in some embodiments, a percussive pulsed air device of the present disclosure may have various means or filtration systems for mitigating caustic nebulizer medicines that may enter the device. One embodiment may include a removable and/or detachable external pre-filter section that may be easily accessible to a user without having to open the housing of the device.

Peak Pulse Pressure Measurements

Efficacious pressure and frequency of a percussive pulsed air device may vary depending on the degree of the patient's bronchial congestion. Accordingly, it may be beneficial to measure peak pulse pressure at one or more locations to determine an indication of the user's congestion. For example, in some embodiments, peak pulse pressure may be measured at a first location, such as where pressurized air enters the patient vest. Additionally or alternatively, peak pulse pressure may be measured at a second location, such as at the user's mouth. Determining a pressure differential between the two locations, at a known frequency, may indicate a state of congestion. This indication of congestion may allow users and caregivers, for example, to track efficacy of the therapy or make adjustments in the pressure and/or frequency settings.

The pressure may be measured at each location via a pressure sensor. For example, a first sensor may be arranged on or within the patient vest. A second pressure sensor may be arranged on or within a mouth piece. The user may hold the mouth piece in his or her mouth, for example with sealed lips, in order to obtain a pressure reading. In some embodiments, the user may only need hold the mouth piece for a few seconds in order to obtain an accurate reading. While the pressure sensors may be incorporated into a therapy device of the present disclosure in some embodiments, in other embodiments, the pressure sensors may comprise or be part of a separate unit.

Figure 28:
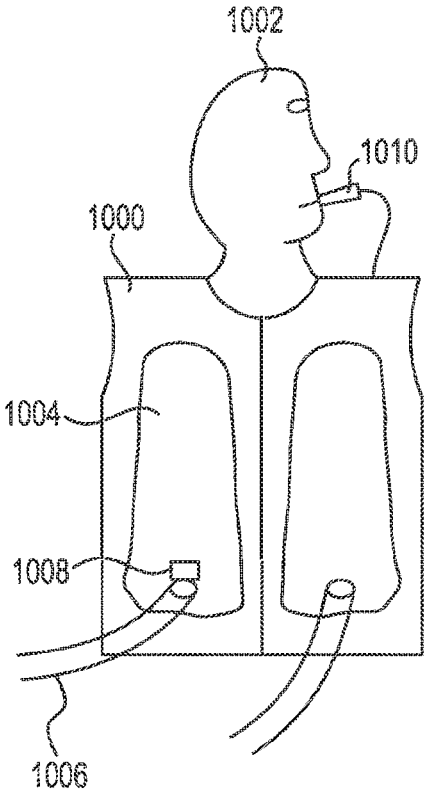
FIG. 28 is a front view of a patient vest of the present disclosure having a vest sensor and a patient sensor, according to one or more embodiments.

For example, FIG. 28 shows a patient vest 1000 of the present disclosure worn by a patient 1002. The vest may have one or more bladders 1004, each configured to receive pressurized air from a pressurized air device of the present disclosure. One or more air ports 1006 may be flowably coupled to each bladder 1004 to deliver the pressurized air thereto. In some embodiments, the vest 1000 may have a vest pressure sensor 1008 and a patient pressure sensor 1010.

The vest pressure sensor 1008 may be configured to measure air pressure at or in the vest 1000. For example, the vest pressure sensor 1008 may measure air pressure as it enters the vest 1000 from an air port 1006. A vest pressure sensor 1008 may be arranged within one or more bladders 1004 and/or within one or more air ports 1006 in some embodiments.

The patient pressure sensor 1010 may be configured to measure air pressure at or in the patient's mouth. The patient pressure sensor 1010 may be configured to be held at the patient's mouth or in the patient's mouth, such as via the lips or teeth. In some embodiments, the pressure sensor 1010 may be coupled to the vest 1000.

In some embodiments, the pressure sensors 1008, 1010 may each communicate with a percussive pulsed air device of the present disclosure via a wired or wireless connection. The percussive pulsed air device may be configured to collect, store, analyze, and/or display the pressures analyzed from the two sensors. Additionally, in some embodiments, pressures detected at each of the sensors 1008, 1010 and/or analysis of those pressures may be accessible and/or displayable via a user interface of the percussive pulsed air device.

Adherence Monitoring

In some cases, a user of a device may make efforts to trick or "spoof" the device. That is, the user may allow the device to operate a therapy session by sending pressurized, pulsed air to a patient vest, while the user is not wearing the vest. Or the user may remove the vest partially through a therapy session, and allow the device to continue running. Thus, the device may record or log that a therapy session was completed, but the user may not have actually received the therapy. Accordingly, some devices, systems, and methods of the present disclosure may provide for detecting this phenomenon.

Figure 18A:
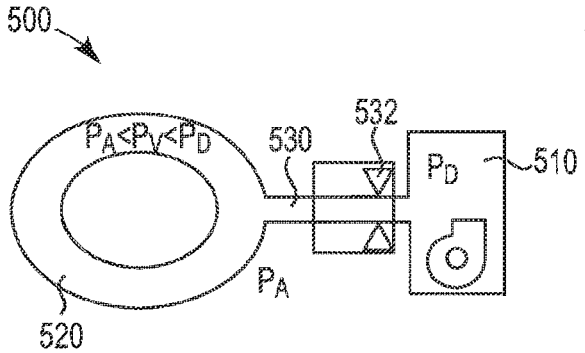
FIG. 18A is a diagram of a percussive pulsed air system of the present disclosure, wherein the system is shown at the start of a pulse and without a user, according to one or more embodiments.
Figure 18B:
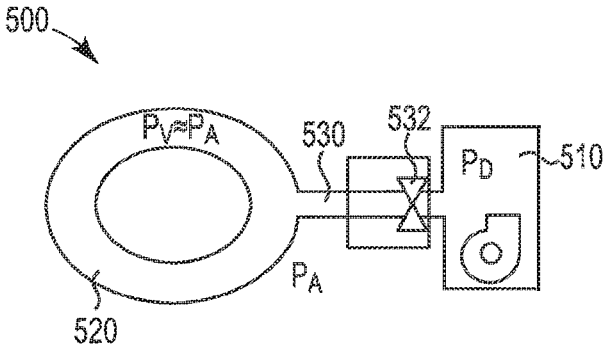
FIG. 18B is a diagram of the percussive pulsed air system of FIG. 18A, wherein the system is shown at the end of a pulse and without a user, according to one or more embodiments.

It may generally be appreciated that a pressure curve of a therapy device operating alone may be different than a pressure curve of the therapy device operating on a living person. FIGS. 18A and 18B illustrate a therapy system 500 operating when person is between breaths. The system 500 may include a pressurized air device 510, which may be similar to the device 10 described above, and a vest 520. The pressurized air device 510 and vest 520 may be flowably coupled via a connection that includes a hose 530. The pulsing pressure cycle of the system 500 may begin with the vest flaccid and an air plenum open to atmospheric pressure (FIG. 18B). The pressurized air device 510 may pressurize the air to a maximum value, $P_D$, which may be achieved when the pressurized air device runs against a deadhead condition, for example. At periodic intervals, a valve 532 may release the pressurized air into the vest 520 via the hose 530, creating a percussive pulse (FIG. 18A). The valve 532 may generally be arranged at any suitable location within the system 500 so as to disrupt airflow to the vest 520. The increase in pressure in the system may have a slope that depends on volume and geometry of the hose and vest, and if allowed to continue, the vest pressure $P_V$ may equilibrate at a value close to $P_D$. At some point, the pressure increase may be interrupted by the evacuation of the system (also caused by the valve 532), after which the system 500 may drop back down to atmospheric pressure. This process may continue repeatedly at frequencies between 5-20 pulses per second.

Figure 18C:
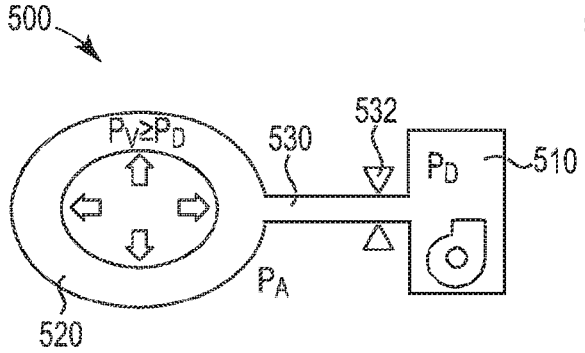
FIG. 18C is a diagram of the percussive pulsed air system of FIG. 18A, wherein the system is shown at peak pulse and with a user during inhalation, according to one or more embodiments.
Figure 18D:
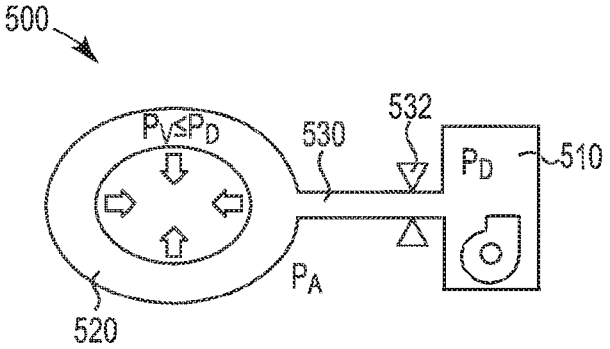
FIG. 18D is a diagram of the percussive pulsed air system of FIG. 18A, wherein the system is shown at peak pulse and with a user during exhalation, according to one or more embodiments.

FIGS. 18C and 18D illustrate the system 500 operating while worn by a user. As the system 500 operates, a user wearing the vest 520 may simultaneously be breathing. Generally, the user may be breathing at a rate of approximately between 12 and 20 breaths per minute. Since normal human respiration involves the expansion and contraction of the rib cage, this expansion may generally modify the shape or amplitude of the system 500 pulses in a periodic fashion. Inspiration causes the chest to expand, which may augment the peak pressure of each pulse (FIG. 18C). Similarly, expiration causes the chest to contract, which may diminish the peak pressure of each pulse (FIG. 18D).

Figure 19:
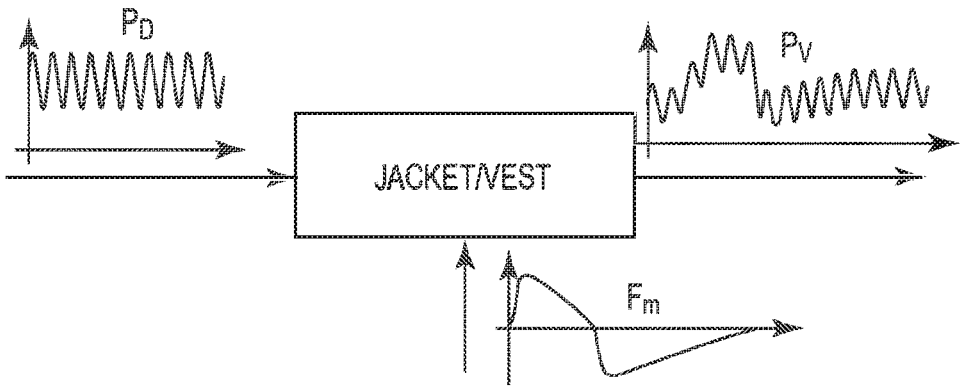
FIG. 19 shows a pulse wave form of a percussive pulsed air system of the present disclosure, a wave form of a user breathing, and a combined wave form showing a user breathing while engaged with the percussive pulsed air system, according to one or more embodiments.

FIG. 19 illustrates a pulse wave form of the system 500, a wave form of a user breathing, and a combined wave form illustrating the respiratory wave form superimposed on the pulse wave form values, which results in variations in peak pressure in the vest. $F_M$ indicates air flow as measured at a user's mouth, $P_V$ indicates pressure of the vest 520, and $P_D$ indicates pressure at the air device 510. Under some circumstances, it may be possible to detect the same pattern at the pulse minimums, as well. When a respiratory wave form is detected, the system may detect whether a living person is wearing the vest.

FIGS. 20A-C illustrate actual oral airflow measurements. FIG. 20A shows a local average between peak and minimum pulse pressure values while the vest 520 is worn by a person. FIG. 20B shows the respiratory wave form for the person in the absence of pulsation. FIG. 20C shows the result of subtracting the respiratory wave form, which leaves the differential pulse component.

The pressure of the vest ($P_V$) may be determined by use of a sensor placed in one or more locations within the system 500. For example, as shown in FIG. 21, a sensor may be arranged within the vest 520 itself, within the hose 530, or generally anywhere between the vest and pressure valve of the pressure device 510. In some embodiments, there may also be a sensor (e.g., optical, magnetic, Hall effect) attached in proximity to the rotating portion of the chopping valve (blade) to detect when peak pressure occurs and assist in synchronizing the process described above. In some embodiments, the one or more pressure sensors, in combination with a processor or controller, may perform any or all of the following steps:

1. Peak $P_V$ Pressure Finding

Alternate 1: Take continuous readings from the $P_V$ sensor at a rate faster than the pulse frequency. Smooth the pressure curve by taking the local average of recent data values. When $P_V$ reaches an upward inflection point (i.e., a peak value), record the peak value and its associated time value in an array. This array may include all peak pressure values since the beginning of the last respiratory cycle.

Alternate 2: When the chopping valve (blade) sensor indicates a peak pressure has been achieved in the vest, record the peak value and its associated time value in an array. This array may include all peak pressure values since the beginning of the last respiratory cycle.

2. Respiratory Wave Finding

Construct a moving average of the peak pressure array. Continuously scan this moving average for upward and downward inflection points. Reject values for which pressure is too high, too low, or for which the interpulse time interval is unrealistic. Define the downward inflection point as the beginning of the respiratory cycle (i.e., the end of expiration). Add the time values for the beginning of the respiratory cycle to an array.

3. Test for Validity

If the most recent inter-breath interval is not physiologically realistic, reset the respiratory cycle array and wait for a new valid breath cycle.

4. Detect No-Breath Condition

If the most recent inter-breath interval is greater than a threshold value (e.g., 1 minutes) set a flag that a non-breath condition has occurred. If breath waveforms are subsequently found, cancel the flag, reset all arrays, and return to Step 2.

5. Notification

If the no-breath condition persists past a threshold value (e.g. 10 minutes), record this occurrence in the event log. The log may be read back from the front screen, either in direct or encrypted form when requested. If desired by the health care provider, the system can send a signal by various electronic means such a Bluetooth or mobile carrier service to a base station. The base station may then inform the health care provider.

In addition to any of the adherence monitoring systems or devices described above, a percussive pulsed air device of the present disclosure may have one or more of the following features. The device may have a means for detecting and/or profiling coughing. For example, the device may have a microphone and/or coughing may be determined based on pressure sensor measurements. This may be used to set up and optimize the system in an initial cycle, for example. In some embodiments, the device may remind a user to cough, for example if it is determined that a user is not coughing frequently enough to effectively dispel mucus. In further embodiments, the system may be used to determine tidal volume, which may in turn be used to determine cough frequency and/or a relationship to the volume of air that has been exhaled at the end of the first second of forced expiration (FEV1). Pressure sensors, including the sensors described above with respect to FIG. 28 for example, may additionally or alternatively be used to determine vest size and optimize therapy accordingly. Pressure sensing may additionally or alternatively be used to determine whether a vest is properly fitted and/or adjusted on a user. For example, pressure sensing may indicate whether the vest is too loose or too tight. Such indication may be provided via a user interface of the percussive pulsed air device, for example. In some embodiments, pressure sensing systems may be used to encourage users to use more aggressive pressures, based on user profiles, for more effective therapies in some embodiments. Any data collected, measured, stored, and/or analyzed with respect to any of the above systems or devices may be provided or accessible via a user interface of the percussive pulsed air device.

Additionally or alternatively, in some embodiments, the percussive pulsed air device may help a patient breathe effectively or learn to breathe effectively. Deep breathing is desirable during therapy to get air movement in the distal portions of the lung. In some embodiments, an inhalation target flow rate may be known or may be determined for the patient based on spirometer measurements or other parameters. One or more sensors may be provided to monitor the patient's breath flow rate during treatment. For example, a sensor may measure breath flow rate at the patient's mouth. A user interface of the percussive pulsed air device may indicate to a patient whether or when the patient has achieved the objective air flow. In some embodiments, a handheld device may provide breath flow indications to the patient. Moreover, any of the above indications or information may be provided via a handheld device.

Generally any of the above mentioned systems, devices, or methods may be used to dynamically allow a user to alter his or her treatment. For example, upon sensing ineffective breathing (such as shallow breaths), ineffective coughing (such as infrequent coughs), ineffective pressure (such as particularly low peak pressures), or ineffective fit (such as the vest is not tight enough or too tight), the percussive pulsed air device may be capable of providing feedback or reminders to a user. Such feedback or reminders may be provided or accessible via a user interface of the percussive pulsed air device. Feedback or reminders may include, for example, a displayed message or image on the user interface, a sound, a vibration of one or more components of the device, and/or other elements. In this way, the user may have an ability to dynamically change the treatment by altering a pressure setting, another setting, breathing, coughing, or any other element in response to real time feedback from the device.

Nebulizer Tube

In some cases, a user or patient may be directed to use an aerosolized medicine to treat their condition, in addition to using HFCC/HFCWO therapy. Oftentimes, the user may use the aerosolized medicine by way of a nebulizer before, during, or after HFCC/HFCWO therapy. Patients may be required to perform each treatment up to two times per day in some cases. The need to use two different therapy devices, particularly multiple times per day, may lead to low adherence. Moreover, when a patient is traveling, it may be cumbersome to transport multiple treatment systems to accommodate therapeutic sessions. In this way, it may be beneficial to provide a system or device that integrates a nebulizer with HFCC/HFCWO therapy.

Figure 22:
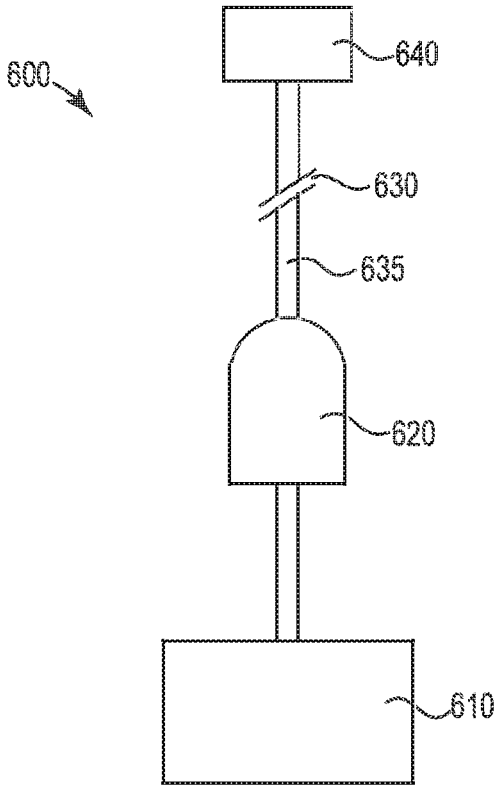
FIG. 22 is a diagram of a percussive pulsed air system having a nebulizer of the present disclosure, according to one or more embodiments.

FIG. 22 illustrates a system 600 of the present disclosure. As shown, the system 600 may have a percussive pulsing therapy device 610, such as device 10 described above or another device of the present disclosure, a patient vest 620, a valve 630, and a nebulizer 640. The percussive pulsing therapy device 610 may generally provide pulsed pressurized air to a bladder arranged within the patient vest 620. An airway 635 may extend from the vest 620, and may lead to the nebulizer 640. The airway may generally allow a portion of the pulsed pressurized air supplied to the vest 620 to be directed toward the nebulizer 640. A valve 630 may allow the airway 635 to be open or closed. The nebulizer 640 may be any suitable nebulizer configured to provide an aerosolized medicine to a user via the user's mouth and/or nose. Air from the vest 620 may travel through the airway 635 to activate the nebulizer 640, and thus deliver aerosolized medicine to the user. In this way, the two treatments (i.e. percussive pulsing therapy and nebulizer therapy) may be effectively and efficiently combined in a single device. Any suitable medication may be provided in this way. This may reduce the amount of time that a patient is required to devote to daily treatments, reduce the amount of equipment that a patient is required to maintain or transport, and may ultimately lead to increased adherence.

Figure 23:
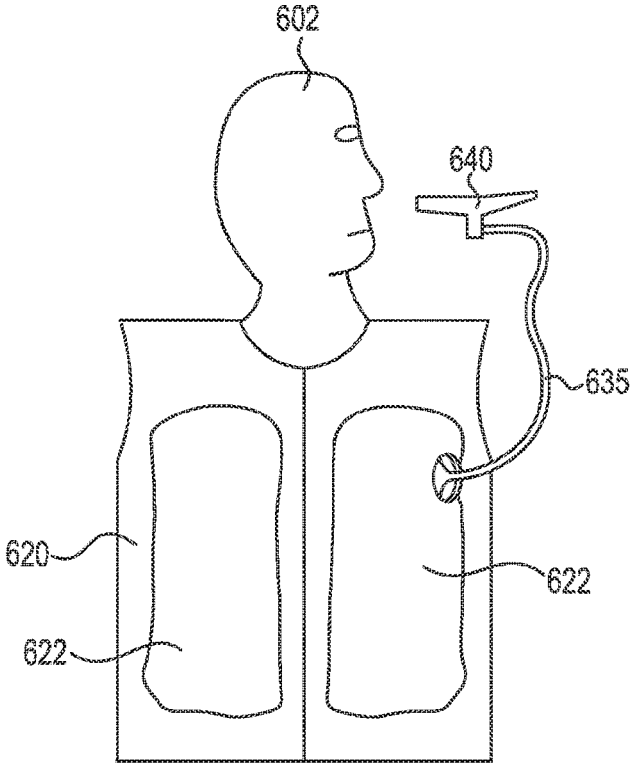
FIG. 23 is a front view of a patient vest and nebulizer of a percussive pulsed air system of the present disclosure, according to one or more embodiments.

FIG. 23 illustrates a user 602 wearing a patient vest 620 of the present disclosure. As shown, the vest 620 may have a bladder 622, which may couple to a percussive pulsing therapy device. Further an airway or conduit 635 may extend from the bladder 622 and deliver air to a nebulizer 640.

Generally, the nebulizer 640 and/or airway 635 may be removable in some embodiments, such that it may be cleaned or stored between uses. The nebulizer 640 may have one or more reservoirs for receiving a medicament to be aerosolized. Moreover, the nebulizer 640 may generally have standard fittings so as to be compatible with standard medicament containers. The nebulizer 640 may have a venturi structure to facilitate delivery of the medicine to the patient's airway. In some embodiments, the nebulizer 640 may provide for adjustments, such as via one or more mechanical adjustment mechanisms, to limit or increase the surface area of an atomizing surface so as to enable the use of a variety of medicines or delivery agents. The airway or conduit 635 may have a choke or regulating element, in addition to or alternative to a valve, that may allow a user to control dosing of the aerosolized medicine. The nebulizer 640 may include one or more dose regulating elements, such as a microperforated, microreplicated, or electrically treated membrane or film in some embodiments.

Generally, the vest 620 may include a valve or other mechanism for opening or closing the airway 635 or otherwise operably directing at least a portion of the pulsed airflow toward the nebulizer 640. The vest 620 may further have a clasp, pocket, or other securing mechanism for securing or storing the nebulizer 640 when not in use. Still further, the vest 620 may have one or more pockets or other storage mechanisms for storing nebulizer medicaments. In some embodiments, the vest 620, airway 635, nebulizer 640, or the coupled percussive pulsed air device may have a means for heating and/or cooling the air provided to the nebulizer. For example, tubing supplying the air to the nebulizer 640 may have a thermoelectric jacket with one or more cooling and/or heating devices such as, for example, one or more Peltier chips, configured to regulate the tubing for heat or cold. In other embodiments, one or more heating coils or other suitable resistive heating elements may be provided in flowable communication with air traveling to the nebulizer 640. In still other embodiments, venturi cooling effects may be used to cool air provided to the nebulizer 640. Heating and/or cooling the nebulizer air may provide for a more effective or comfortable treatment in some embodiments. In some embodiments, the nebulizer 600 may be joined to other portable components, such as but not limited to battery powered air pumps or sensors for monitoring and/or regulating performance.

In some embodiments, use of the nebulizer may be monitored and/or recorded. For example, a patient's number of users, length of use, and/or other data associated with use of the nebulizer may be monitored, recorded, and/or analyzed. As a particular example, a piezoelectric film may help to monitor use of the nebulizer. Data associated with the patient's use of the nebulizer may be provided or accessible via a user interface of a percussive pulsed air device of the present disclosure.

Combined IPV and HFCC/HFCWO

Intrapulmonary percussive ventilation (IPV) is a percussive air therapy that may benefit patients with one or more of the conditions or diseases described herein. IPV generally includes delivery of percussive air to the patient's airways via a mouth device. IPV may generally provide a therapeutic benefit directed toward a patient's upper airways, while HFCC/HFCWO may generally provide a therapeutic benefit directed toward a patient's lower airways. In this way, combining IPV therapy with HFCC/HFCWO therapy may be particularly beneficial for patients with excess mucus in the airways.

Figure 24A:
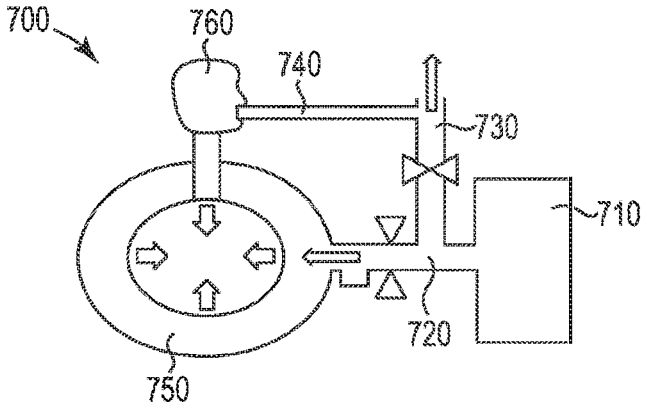
FIG. 24A is a diagram of a percussive pulsed air system having an IPV component of the present disclosure, wherein the system is shown in a compressive phase, according to one or more embodiments.
Figure 24B:
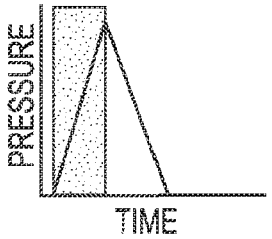
FIG. 24B shows a peak wave form of the system shown in FIG. 24A, according to one or more embodiments.
Figure 25A:
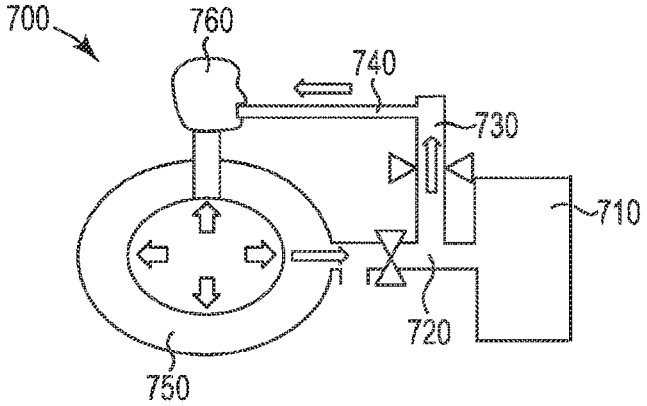
FIG. 25A is a diagram of the percussive pulsed air system of FIG. 24A, wherein the system is shown in an exhaust phase, according to one or more embodiments.
Figure 25B:
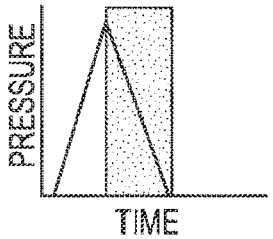
FIG. 25B shows a peak wave form of the system shown in FIG. 25A.
Figure 26:
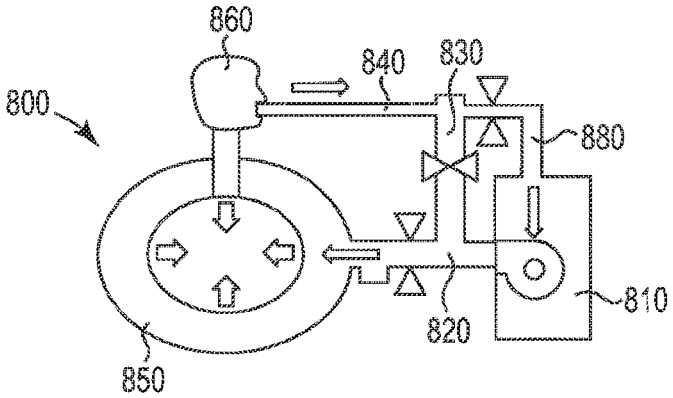
FIG. 26 is a diagram of a percussive pulsed air system having an IPV component of the present disclosure, according to one or more embodiments.

FIGS. 24A-B and 25A-B illustrate one embodiment a therapy system 700 combining IPV and HFCC/HFCWO therapies. As shown for example in FIG. 24A, the system 700 may have a percussive pulsed air device 710, a vest airway 720, a bypass airway 730, and an IPV airway 740. The system 700 may further include a vest 750 worn by a user 760. The percussive pulsed air device 710 may be similar to device 10 discussed above, for example. The device 710 may provide percussive pulsed air to the vest 750, providing HFCC/HFCWO therapy. In addition, the bypass airway 730 may allow at least a portion of the percussive air produced by the device 710 to be directed through an IPV airway 740 to provide IPV therapy to the user 760. FIG. 24A illustrates the system 700 during a compressive phase of the HFCC/HFCWO pulse, wherein pulsed air may be delivered to the vest 750. As shown, the bypass airway 730 may be closed while the vest airway 720 is open. FIG. 24B illustrates the portion of the pressure wave form represented by FIG. 24A. FIG. 25A illustrates the system 700 during an exhaust phase of the HFCC/HFCWO pulse, wherein percussive air may be delivered to the IPV airway 740. As shown, the bypass airway 730 may be open while the vest airway 720 is closed. FIG. 25B illustrates the portion of the pressure wave form represented by FIG. 25A. FIG. 26 illustrates an alternate system 800, additionally having an exhaust airway 880, allowing exhaust from the IPV airway 840 to be returned to the device 810. As shown, when the vest airway 820 is open (i.e. in a compression phase of the HFCC/HFCWO), the bypass airway 830 may be closed and the exhaust airway 880 may be open and exposed to the air inlet of device 810, which draws a negative pressure at the mouth. Similarly, when the vest airway 820 is closed (i.e. in an exhaust phase of the HFCC/HFCWO), the bypass airway 830 may be open and the exhaust airway 880 may be closed. It is manifest that any one or combination of the mechanisms for opening and closing the various airways described above may have provisions for regulating the volume of air, the periodic timing and synchronization of the mechanisms, and/or any other desirable parameters associated with the system.

Figure 27:
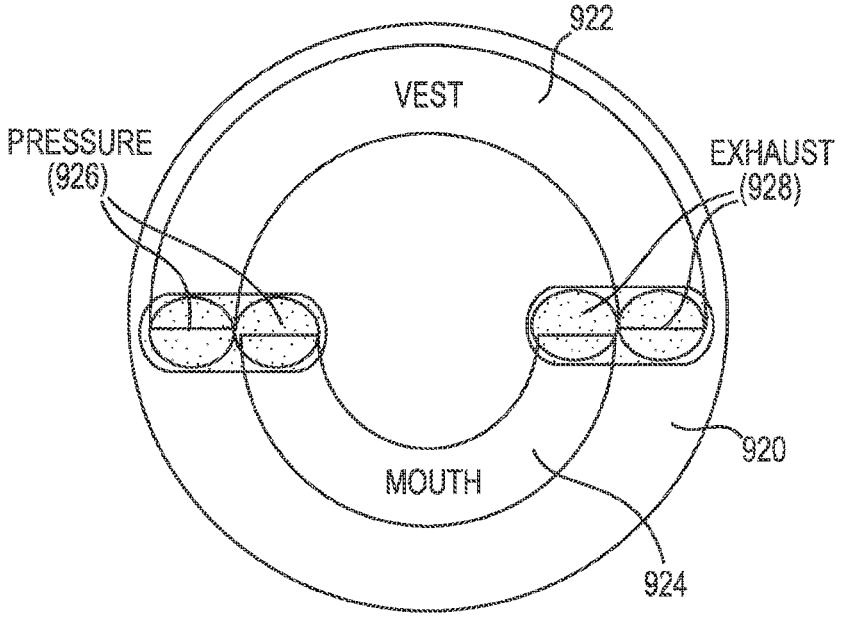
FIG. 27 is a blade of a frequency control module of a percussive pulsed air system of the present disclosure, wherein the blade allows for IPV therapy, according to one or more embodiments.

To accomplish the dual therapies, the device 710, 810 may include a synchronized valve, such as a blade. The blade may operate similar to blade 20 discussed above. FIG. 27 illustrates one embodiment of a blade 920 configured to provide IPV and HFCC/HFCWO therapies through a single system. As shown, the blade 920 may have one or more cutouts. A first cutout may be a vest cutout 922. The vest cutout 922 may allow air to pass through the blade 920 so as to provide pressurized air to a patient vest, thus providing HFCC/HFCWO therapy. A second cutout may be a mouth cutout 924. The mouth cutout 924 may allow air to pass through the blade 920 so as to provide pressurized air to an IPV airway or other IPV device, thus providing IPV therapy. As shown, the two cutouts 922, 924 may be on opposing sides of the blade 920 in some embodiments, such that the pressurized air may alternate between feeding the two different therapies. That is, as the blade 920 rotates, the mouth cutout 924 may be in a deadhead phase while the vest cutout 922 is allowing air to pass. Similarly, the vest cutout 922 may be in a deadhead phase while the mouth cutout 924 allows air to pass. FIG. 27 further illustrates two pressure ports 926 and two exhaust ports 928 that may be arranged on or in flowable communication with the blade 920. Particularly, one pressure port 926 may provide pressurized air to pass through the vest cutout 922, and a second pressure valve may provide pressurized air to pass through the mouth cutout 924. Similarly, one exhaust port 928 may receive air passing through the vest cutout 922, while a second exhaust port 928 receives air passing through the mouth cutout 924.

Generally, the systems 700, 800 may provide different pressures and/or air volumes to each of the vest and IPV airway. In some embodiments, a flow valve may be used to control airflow to the IPV. Moreover, it may be appreciated that in some embodiments, a negative pressure may be used within the IPV airway, in order to, for example, draw air out of the user's mouth.

Active Pressure Release During Inhalation

A percussive pulsed air system of the present disclosure may be configured to vent air to the atmosphere, as described above or during patient exhalation. In some embodiments, the air may be vented continuously during a therapy session. It may be appreciated that continued, controlled ventilation through the device may allow for patient chest expansion during inhalation during therapy, thus allowing air to reach the distal airways of the lung. Air movement in all portions of the lung may optimize effective mucus clearance when using HFCC therapy. Further reduction of resistance to patient chest expansion during inhalation would be beneficial in that it would allow higher volume patient inhalation with less effort. In some embodiments, a pressure relief valve may be arranged on the percussive pulsed air device. The valve may be operated manually or automatically. In some embodiments, the valve may be operated to release air from the device in synchronicity with the patient's breathing. In some embodiments, one or more respiratory rate sensors may be used to sense the inhalation portion of the respiratory cycle, and may be configured to automatically trigger the pressure relief valve to open. The one or more respiratory rate sensors may be arranged on the patient vest, in the device, and/or at another suitable location. The valve may remain open for a measured or predetermined period of time. This time period may be around one or two seconds, dropping the pressure slightly, and allowing the user to inhale more air volume with the same or less effort. Additionally or alternatively, in some embodiments, a valve may be arranged on the patient vest to allow venting of the vest.

Patient Mouthpiece

In addition to or in combination with the patient sensor 1010 described above with respect to FIG. 28, in some embodiments, a patient mouthpiece may be provided for monitoring spirometry and/or congestion. The mouthpiece may be configured to measure airflow at the patient's mouth and may be configured to produce little or no resistance noticeable to the patient. Pressure at one or more locations, such as at either side of the patient's mouth, may be measured with a differential pressure sensor during a patient therapy session. Any suitable pressure sensor may be used. In some embodiments, the one or more pressure sensors may be configured to measure air flow through the mouth piece over a range of between approximately zero and approximately twelve liters per second. In some embodiments, the one or more sensors of the mouthpiece may be configured to measure total volume of air expired in the first one second of a forced expiratory breath, for example. In some embodiments, the patient mouthpiece may be similar to, or incorporate aspects of those described in U.S. Patent Publication No. 2010/0249634, entitled Mouthpiece and Airway Congestion Monitoring System, and filed Mar. 19, 2010, the contents of which are hereby incorporated by reference herein in their entirety.

In some embodiments, the mouthpiece may communicate with the percussive pulsed air device over a wired or wireless connection. The measured pressure information may be recorded, stored, and/or analyzed. The recorded, stored, and/or analyzed data may be provided or available to a user via the user interface of the percussive pulsed air device. In some embodiments, the recorded, stored, and/or analyzed data may be used to provide encouragement and/or incentive to the user to teach correct or beneficial breathing.

Additionally, in some embodiments, a percussive pulsed air device of the present disclosure may include a handheld device, such as but not limited to a pneumotachometer, to measure air flows at the patient's mouth. The device may be used to measure airflow velocity at the patient's mouth during a therapy session to determine effective frequencies for the particular patient. That is, each patient may have a frequency, number of frequencies, or range of frequencies that are most effective. In some embodiments, the patient may hold the handheld device to measure air flow at the patient's mouth while the percussive pulsed air device cycles through different frequencies. The induced air flow pulse may be measured at each frequency over the frequency range and a mean induced air flow rate calculated for each frequency. Those individual frequencies that produce the highest induced air flow rates may be considered the most effective in clearing mucus from the airways. In this way, effective frequencies for the patient may be determined based on higher airflow readings at the patient's mouth. In some embodiments, for example, induced pressure pulses at each frequency may be recorded and the average amplitude may be calculated for each frequency, so that optimal frequencies may be identified. This data may in turn be used to determine therapy settings for the patient. The airflow and/or frequency data may be stored and/or analyzed. The stored and/or analyzed data may be provided or available via a user interface of the percussive pulsed air device in some embodiments.

For purposes of this disclosure, any system described herein may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, a system or any portion thereof may be a personal computer (e.g., desktop or laptop), tablet computer, mobile device (e.g., personal digital assistant (PDA) or smart phone), server (e.g., blade server or rack server), a network storage device, or any other suitable device or combination of devices and may vary in size, shape, performance, functionality, and price. A system may include random access memory (RAM), one or more processing resources such as a central processing unit (CPU) or hardware or software control logic, ROM, and/or other types of nonvolatile memory. Additional components of a system may include one or more disk drives or one or more mass storage devices, one or more network ports for communicating with external devices as well as various input and output (I/O) devices, such as a keyboard, a mouse, touchscreen and/or a video display. Mass storage devices may include, but are not limited to, a hard disk drive, floppy disk drive, CD-ROM drive, smart drive, flash drive, or other types of non-volatile data storage, a plurality of storage devices, or any combination of storage devices. A system may include what is referred to as a user interface, which may generally include a display, mouse or other cursor control device, keyboard, button, touchpad, touch screen, microphone, camera, video recorder, speaker, LED, light, joystick, switch, buzzer, bell, and/or other user input/output device for communicating with one or more users or for entering information into the system. Output devices may include any type of device for presenting information to a user, including but not limited to, a computer monitor, flat-screen display, or other visual display, a printer, and/or speakers or any other device for providing information in audio form, such as a telephone, a plurality of output devices, or any combination of output devices. A system may also include one or more buses operable to transmit communications between the various hardware components.

One or more programs or applications, such as a web browser, and/or other applications may be stored in one or more of the system data storage devices. Programs or applications may be loaded in part or in whole into a main memory or processor during execution by the processor. One or more processors may execute applications or programs to run systems or methods of the present disclosure, or portions thereof, stored as executable programs or program code in the memory, or received from the Internet or other network. Any commercial or freeware web browser or other application capable of retrieving content from a network and displaying pages or screens may be used. In some embodiments, a customized application may be used to access, display, and update information.

Hardware and software components of the present disclosure, as discussed herein, may be integral portions of a single computer or server or may be connected parts of a computer network. The hardware and software components may be located within a single location or, in other embodiments, portions of the hardware and software components may be divided among a plurality of locations and connected directly or through a global computer information network, such as the Internet.

As will be appreciated by one of skill in the art, the various embodiments of the present disclosure may be embodied as a method (including, for example, a computer-implemented process, a business process, and/or any other process), apparatus (including, for example, a system, machine, device, computer program product, and/or the like), or a combination of the foregoing. Accordingly, embodiments of the present disclosure may take the form of an entirely hardware embodiment, an entirely software embodiment (including firmware, middleware, microcode, hardware description languages, etc.), or an embodiment combining software and hardware aspects. Furthermore, embodiments of the present disclosure may take the form of a computer program product on a computer-readable medium or computer-readable storage medium, having computer-executable program code embodied in the medium, that define processes or methods described herein. A processor or processors may perform the necessary tasks defined by the computer-executable program code. Computer-executable program code for carrying out operations of embodiments of the present disclosure may be written in an object oriented, scripted or unscripted programming language such as Java, Perl, PHP, Visual Basic, Smalltalk, C++, or the like. However, the computer program code for carrying out operations of embodiments of the present disclosure may also be written in conventional procedural programming languages, such as the C programming language or similar programming languages. A code segment may represent a procedure, a function, a subprogram, a program, a routine, a subroutine, a module, an object, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

In the context of this document, a computer readable medium may be any medium that can contain, store, communicate, or transport the program for use by or in connection with the systems disclosed herein. The computer-executable program code may be transmitted using any appropriate medium, including but not limited to the Internet, optical fiber cable, radio frequency (RF) signals or other wireless signals, or other mediums. The computer readable medium may be, for example but is not limited to, an electronic, magnetic, optical, electromagnetic, infrared, or semiconductor system, apparatus, or device. More specific examples of suitable computer readable medium include, but are not limited to, an electrical connection having one or more wires or a tangible storage medium such as a portable computer diskette, a hard disk, a random access memory (RAM), a read-only memory (ROM), an erasable programmable read-only memory (EPROM or Flash memory), a compact disc read-only memory (CD-ROM), or other optical or magnetic storage device. Computer-readable media includes, but is not to be confused with, computer-readable storage medium, which is intended to cover all physical, non-transitory, or similar embodiments of computer-readable media.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart may illustrate a method as a sequential process, many of the operations in the flowcharts illustrated herein can be performed in parallel or concurrently. In addition, the order of the method steps illustrated in a flowchart may be rearranged for some embodiments. Similarly, a method illustrated in a flow chart could have additional steps not included therein or fewer steps than those shown. A method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an ingredient or element may still actually contain such item as long as there is generally no measurable effect thereof.

Various devices, systems, and methods for HFCC/HFCWO therapies have been described. It may be appreciated that any of the embodiments, features, components, systems, methods, or other elements described herein may be combined with any other embodiments, features, components, systems, methods, or other elements described herein. Moreover, it may be appreciated that any of the embodiments, features, components, systems, methods or other elements described herein may be incorporated into a particularly portable percussive pulsed air device of the present disclosure. That is, in some embodiments, a percussive pulsed air device may be particularly compact or may be easily assembled/disassembled in some embodiments, such that a user may more easily travel with the device.

We claim:

1. A percussive pulsed air device, comprising:

an airflow generator controlling an amplitude of the percussive pulsed air;

a pulse frequency control module controlling a frequency of the percussive pulsed air, the pulse frequency control module comprising a rotatable fan blade having at least one cutout portion structured to allow air to pass through the fan blade and at least one dado channel provided on a first face of the fan blade such that the at least one dado channel is not a cutout structured to allow air to pass through the fan blade; and one or more ports for flowably coupling to a patient device.

2. The percussive pulsed air device of claim 1, wherein the patient device is a patient vest.

3. The percussive pulsed air device of claim 1, further comprising a user interface.

4. The percussive pulsed air device of claim 1, wherein the fan blade comprises a circular shape.

5. The percussive pulsed air device of claim 4, wherein the at least one cutout portion is arranged on a first half of the fan blade, and wherein a second half of the fan blade does not have a cutout portion.

6. The percussive pulsed air device of claim 4, wherein the fan blade comprises two cutout portions.

7. The percussive pulsed air device of claim 5, wherein the cutout portion comprises a substantially arced shape or a substantially semi-circular shape.

8. The percussive pulsed air device of claim 1, wherein the at least one cutout portion is arranged on a first half of the fan blade, and wherein the at least one dado channel is arranged on a second half of the fan blade.

9. The percussive pulsed air device of claim 1, wherein the at least one channel redirects airflow from the airflow generator to an exhaust.

10. The percussive pulsed air device of claim 1, wherein the at least one dado channel comprises a substantially arced shape or a substantially semi-circular shape.

11. The percussive pulsed air device of claim 1, further comprising a pressure control unit for receiving the percussive pulsed air from the pulse frequency control module and providing the percussive pulsed air to the patient device via the one or more ports.

12. A percussive pulsed air device, comprising:

an airflow generator controlling an amplitude of the percussive pulsed air;

a pulse frequency control module controlling a frequency of the percussive pulsed air;

a first port and a second port provided on the pulse frequency control module, one or more of the first port and the second port being for directing airflow into the pulse frequency control module in a first direction, wherein a first line is defined through a center point of the first port and a center point of the second port and wherein the first direction is perpendicular to the first line;

a pressure control unit for receiving the percussive pulsed air from the pulse frequency control module and providing the percussive pulsed air to a patient device; and a third port and a fourth port provided on the pressure control unit, one or more of the third port and the fourth port being for directing airflow from the pulse frequency control module, wherein a second line is defined through a center point of the third port and a center point of the fourth port;

wherein the first line is transverse to the second line, and wherein the first line is arranged at a 45 degree angle with respect to the second line.

13. The percussive pulsed air device of claim 12, wherein the first line is perpendicular to the second line.

* * * * *